US011304529B2

(12) United States Patent
Lee et al.

(10) Patent No.: US 11,304,529 B2
(45) Date of Patent: Apr. 19, 2022

(54) WORK CHAIR

(71) Applicant: EDENVIEW CO., LTD, Gwangju (KR)

(72) Inventors: Jin Guk Lee, Gwangju (KR); Young Im Park, Gwangju (KR); Jong Pill Oh, Jeollanam-do (KR)

(73) Assignee: EDENVIEW CO., LTD, Gwangju (KR)

( * ) Notice: Subject to any disclaimer, the term of this patent is extended or adjusted under 35 U.S.C. 154(b) by 0 days.

(21) Appl. No.: 16/771,070

(22) PCT Filed: Sep. 17, 2018

(86) PCT No.: PCT/KR2018/010891

§ 371 (c)(1),
(2) Date: Jun. 9, 2020

(87) PCT Pub. No.: WO2019/124683

PCT Pub. Date: Jun. 27, 2019

(65) Prior Publication Data

US 2022/0053937 A1 Feb. 24, 2022

(30) Foreign Application Priority Data

Dec. 24, 2017 (KR) ..... 10-2017-0178960
Apr. 27, 2018 (KR) ..... 10-2018-0048878

(51) Int. Cl.
*A47C 3/16* (2006.01)
*A47C 9/02* (2006.01)
(Continued)

(52) U.S. Cl.
CPC ..... *A47C 3/16* (2013.01); *A47C 7/18* (2013.01); *A47C 7/62* (2013.01); *A47C 9/027* (2013.01)

(58) Field of Classification Search
CPC .... A47C 3/16; A47C 7/18; A47C 7/62; A47C 9/027
(Continued)

(56) References Cited

U.S. PATENT DOCUMENTS 1,267,953 A * 5/1918 Zolp ..... A47C 9/027 297/4
2,480,406 A * 8/1949 Forney ..... A41D 13/065 182/3
(Continued)

FOREIGN PATENT DOCUMENTS

KR 20199800000501 U 3/1998
KR 10-2012-0059742 A 6/2012
(Continued)

OTHER PUBLICATIONS

International Search Report (dated Dec. 24, 2018) for corresponding International App. PCT/KR2018/010891.
(Continued)

*Primary Examiner* — Mark R Wendell
(74) *Attorney, Agent, or Firm* — WRB-IP LLP

(57) ABSTRACT

A work chair is provided herein a worker wears a pelvis belt in a transverse direction from both sides of a cushion chair so as to surround the pelvis, while simultaneously wearing a safety belt between both legs and along the front of the pelvis belt in a longitudinal direction by pulling the lower side of the cushion chair, thus allowing the centering position of the cushion chair to be firmly held against the buttocks around the anus, even when the worker repeatedly sits down and stands up and waddles, and maximizing convenience of use. Moreover, by correctly positioning the cushion chair, the worker can be prevented from filling on his or her buttocks while working, thus ensuring safety during use. Furthermore, the work chair ensures that the cushion chair is centered around the anus when the safety
(Continued)

belt is worn, whereas an attachment/detachment ring is returned upward and fitted into a collecting ring when the safety belt is not worn. Accordingly, the length of the safety belt itself is simply reduced to be small, thus preventing safety accidents. Also, the safety belt is prevented from haphazardly hanging out when storing the work chair, thus ensuring tidiness when the work chair is stored.

6 Claims, 34 Drawing Sheets

(51) Int. Cl.
*A47C 7/62* (2006.01)
*A47C 7/18* (2006.01)

(58) Field of Classification Search
USPC ..... 297/4
See application file for complete search history.

(56) References Cited

U.S. PATENT DOCUMENTS 2,621,327 A * 12/1952 Amoroso ..... A41D 13/0007 2/467
2,829,386 A * 4/1958 Peer ..... B63C 9/08 441/127
4,025,105 A * 5/1977 Pekala ..... A47C 7/021 297/4
2007/0257523 A1* 11/2007 Westfall ..... A47C 9/027 297/4

FOREIGN PATENT DOCUMENTS

KR 10-2013-0069009 A 6/2013
KR 10-1338273 B1 12/2013
KR 2016100448 * 8/2016
KR 10-2016-0125856 A 11/2016
KR 2017133248 * 12/2017
KR 2018016225 * 2/2018
KR 2018077119 * 7/2018
KR 2018110773 * 10/2018
KR 2018113009 * 10/2018

OTHER PUBLICATIONS

ZZOGRI, Useful Product for Fann Working, Launching a New Product "ZZOGRI 4.0" Applied Safely Belt Newsay, [online], Jan. 25, 2018, [Retrieved on Nov. 15, 2018], Internet: <URL: http://wvvw.newsway.co kr/news/view?tp=20I8012516583755514> See the pictures.

* cited by examiner

WORK CHAIR

BACKGROUND AND SUMMARY

The present invention relates to a work chair, and MOM particularly to a work chair, in which a worker fastens a pelvis belt in a lateral direction so as to wrap around the pelvis from opposite sides of a cushion chair, pulls up the lower portion of the cushion chair, and further fastens a safety belt to the front portion of the pelvis belt in a vertical direction between the legs, thereby firmly centering the cushion chair on a part of the buttocks around the anus even when the worker repeatedly sits and stands or walks while squatting.

In general, a work chair is work support equipment for protecting the knees, the waist, etc. by dispersing a worker's weight through a cushion chair, which is positioned on the buttocks and is in contact with the ground when the worker works while kneeling or squatting in agricultural and fishing villages or in various industrial sites.

FIG. 1A shows a picture showing a work chair according to Conventional Art Document 1 (Design Registration No. 0745435), FIG. 1B shows pictures showing the state in which a work chair of the same type as that in Conventional Art Document 1 is used when viewed from the front and the rear, and FIG. 1C shows a picture and an image respectively showing the method of using a work chair of the same type as that in Conventional Art Document 1 and the state of use of the work chair.

As shown in FIGS. 1A and 1B, the work chair according to Conventional Art Document 1 includes a cushion chair C, which is brought into close contact with the buttocks to cushion the same, and further includes a left-leg band L and a right-leg band R, which are fixed to the upper portion of the cushion chair C and are arranged close to and parallel to each other in a "11" shape so as to be respectively worn around the left and right sides of the crotch.

As can be seen from the picture showing the method of using the work chair according to Conventional Art Document 1 and the image showing the state of use of the same in FIG. 1C, there is a problem in that it is very inconvenient for a worker to use the work chair because the worker needs to spread the left-leg band L and the right-leg band R, put the legs into the bands, and pull the bands up over both thighs.

FIGS. 2A and 2B are images showing the state of use of a work chair disclosed as the conventional art in Conventional Art Document 2 (U.S. Pat. No. 1,562,177).

As shown in FIGS. 2A and 2B, the work chair disclosed as the conventional art in Conventional Art Document 2 includes a cushion chair C, which is brought into close contact with the buttocks to cushion the same, and a pelvis band B, which is fixed to the upper portion of the cushion chair C in a lateral direction so as to be worn around the pelvis.

However, when the worker, who uses the work chair disclosed in Conventional Art Document 2, repeatedly sits and stands, the cushion chair C tends to ascend above the buttocks, which may cause the worker to fall on his/her buttocks. Considering such shortcomings, whenever the worker sits down, the worker needs to pull the cushion chair C down to the buttocks with the hands, which incurs a problem of deteriorated working efficiency.

It is desirable to provide a work chair in which a worker fastens a pelvis belt in a lateral direction so as to wrap around the pelvis from opposite sides of a cushion chair, pulls up the lower portion of the cushion chair, and further fastens a safety belt to the front portion of the pelvis belt in a vertical direction between the legs, thereby firmly centering the cushion chair on a part of the buttocks around the anus even when the worker repeatedly sits and stands or walks while squatting.

It is desirable to provide a work chair in which, when the safety belt is worn, the safety belt centers the cushion chair on a part of the buttocks around the anus, and when the safety belt is not worn, a fastening hook is returned upwards and hooked to a collection ring so that the safety belt is reduced in length, thereby protecting the worker from accidents, and preventing the safety belts from hanging down in disorder when the work chairs are stored, thus enabling storage of the work chairs in a neat and tidy manner.

It is desirable to provide a work chair in which a fixing band is sewn to the boundary between a bottom-surface cover member and a side-surface cover member, thereby ensuring firm fixation thereof when the safety belt is worn, thus increasing the lifespan thereof, in which the fixing band is further sewn to the side-surface cover member while extending upwards and then extending downwards, thereby further enhancing firmness of fixation thereof, and in which a horizontal fixing bar is inserted into a horizontal fixing hole formed in the upper end of the fixing band so as to be rotatable in a vertical direction, thereby enabling the fastening hook to be smoothly hooked to and released from a rounded fixing bar, thus ensuring convenience in use.

It is desirable to provide a work chair in which the force by which the safety belt is fastened is capable of being reduced by hooking the fastening hook to a fixing ring provided at a front surface of the cushion chair, and the force by which the safety belt is fastened is capable of being increased (to be tighter around the thighs) by hooking the fastening hook to a fixing ring provided at each of a left surface and a right surface of the cushion chair, thereby enabling the worker to selectively fasten the safety belt so that the worker feels comfortable, thus maximizing convenience in use.

It is desirable to provide a work chair in which the collection ring is fixed to the pelvis belt together with the safe belt in a manner such that a collection band extends upwards and then extends downwards while contacting the pelvis belt, with the safety belt sandwiched therebetween, and is sewn to the pelvis belt while again extending upwards over the safety belt, thereby ensuring firm fixation of the safety belt, and in which a horizontal collection bar of the collection ring is inserted into a horizontal collection hole formed in the lower end of the collection band so as to be rotatable in a vertical direction thereby enabling the fastening hook to be smoothly hooked thereto and released therefrom, thus maximizing convenience in use.

It is desirable to provide a work chair in which a horizontal fastening bar of the fastening hook rotates in a vertical direction in the state of being inserted into a horizontal fastening hole, and firmly supports a rounded fastening bar, which extends from opposite ends thereof and is bent in a closed-loop shape, thereby preventing separation of the fastening hook during use and facilitating selective fastening of the fastening hook to the fixing ring or to the collection ring using the rounded fastening bar, which is rounded an open shape, thus ensuring convenience in use.

It is desirable to provide a work chair capable of preventing unintended release of the fastening hook from the fixing ring or from the collection ring, thereby maintaining a more firmly fastened state.

It is desirable to provide a work chair capable of maximizing convenience and safety in use.

It is desirable tea provide a work chair having a simple structure and capable of improving working efficiency.

It is desirable to provide a work chair capable of facilitating fastening and release of the safety belt.

The present invention, according to an aspect thereof, provides a work chair including:

a cushion chair configured to be brought into close contact with the buttocks to cushion the buttocks and a pelvis belt fixed to each of opposite sides of the cushion chair and configured to be removably worn around the pelvis.

wherein the work chair includes a safety belt detachably secured to the lower portion of the cushion chair 10 and to the front portion of the pelvis belt so as to center the cushion chair on a part of the buttocks around the anus, wherein the safety belt is fixed to the lower portion of the cushion chair and is detachably fastened to the front portion of the pelvis belt, wherein the pelvis belt includes a main pelvis belt, fixed to each of opposite sides of the upper portion of the cushion chair and removably worn around the pelvis in a horizontal direction, and an auxiliary pelvis belt, fixed to opposite sides of the lower middle portion of the cushion chair, extending in an oblique direction, and fixed to the main pelvis belt so as to be worn around the pelvis, and wherein the safety belt is fixed to the lower portion of the cushion chair and is detachably fastened to opposite sides of the front portion of the auxiliary pelvis belt over both thighs so that the gap between the main pelvis belt and the auxiliary pelvis belt is increased, and the cushion chair, centered on a part of the buttocks around the anus, is firmly held by a three-dimensional triangular structure formed by the main pelvis belt, the auxiliary pelvis belt and the safety belt.

The present invention, according to an aspect thereof, provides a work chair including:

a cushion chair configured to be brought into close contact with the buttocks to cushion the buttocks and a pelvis belt fixed to each of opposite sides of the cushion chair and configured to be removably worn around the pelvis, wherein the work chair includes a safety belt detachably secured to the lower portion of the cushion chair and to the front portion of the pelvis belt so as to center the cushion chair on a part of the buttocks around the anus, wherein the safety belt is fixed to the front portion of the pelvis belt and is detachably fastened to the lower portion of the cushion chair, wherein the pelvis belt includes a main pelvis belt, fixed to each of opposite sides of the upper portion of the cushion chair and removably worn around the pelvis in a horizontal direction, and an auxiliary pelvis belt, fixed to opposite sides of the lower middle portion of the cushion chair, extending in an oblique direction, and fixed to the main pelvis belt so as to be worn around the pelvis, and wherein the safety belt is fixed to opposite sides of the front portion of the auxiliary pelvis belt and is detachably fastened to the lower portion of the cushion chair so that the gap between the main pelvis belt and the auxiliary pelvis belt is increased, and the cushion chair, centered on a part of the buttocks around the anus, is firmly held by a three-dimensional triangular structure formed by the main pelvis belt, the auxiliary pelvis belt and the safety belt, The present invention, according to an aspect thereof, provides a work chair including:

a cushion chair configured to be brought into close contact with the buttocks to cushion the buttocks and a pelvis belt fixed to each of opposite sides of the cushion chair and configured to be removably worn around the pelvis, wherein the work chair includes a safety belt detachably secured to the lower portion of the cushion chair and to the front portion of the pelvis belt so as to center the cushion chair on a part of the buttocks around the anus, wherein the safety belt is detachably fastened to the lower portion of the cushion chair and to the front portion of the pelvis belt, wherein the pelvis belt includes a main pelvis belt, fixed to each of opposite sides of the upper portion of the cushion chair and removably worn around the pelvis in a horizontal direction, and an auxiliary pelvis belt, fixed to opposite sides of the lower middle portion of the cushion chair, extending in an oblique direction, and fixed to the main pelvis belt so as to be worn around the pelvis, and wherein the safety belt is detachably fastened to the lower portion of the cushion chair and to opposite sides of the front portion of the auxiliary pelvis belt over both thighs so that the gap between the main pelvis belt and the auxiliary pelvis belt is increased, and the cushion chair, centered on a part of the buttocks around the anus, is firmly held by a three-dimensional triangular structure formed by the main pelvis belt, the auxiliary pelvis belt and the safety belt.

The present invention, according to an aspect thereof, provides a work chair including:

a cushion chair configured to be brought into close contact with the buttocks to cushion the buttocks and a pelvis belt fixed to each of opposite sides of the cushion chair and configured to be removably worn around the pelvis, wherein the work chair includes a safety belt detachably secured to the lower portion of the cushion chair and to the front portion of the pelvis belt so as to center the cushion chair on a part of the buttocks around the anus, wherein the pelvis belt includes a main pelvis belt, fixed to each of opposite sides of the upper portion of the cushion chair and removably worn around the pelvis in a horizontal direction, and an auxiliary pelvis belt, fixed to opposite sides of the lower middle portion of the cushion chair, extending in an oblique direction, and fixed to the main pelvis belt so as to be worn around the pelvis, and wherein the safety belt includes an upper-oblique safety belt extending from a lower-center safety belt, fixed to the lower portion of the cushion chair, and detachably fastened to opposite sides of the front portion of the auxiliary pelvis belt over both thighs so that the gap between the main pelvis belt and the auxiliary pelvis belt is increased, and the cushion chair, centered on a part of the buttocks around the anus, is firmly held by a three-dimensional triangular structure formed by the main pelvis belt, the auxiliary pelvis belt and the safety belt.

The present invention, according to an aspect thereof, provides a work chair including:

a cushion chair configured to be brought into close contact with the buttocks to cushion the buttocks and a pelvis belt fixed to each of opposite sides of the cushion chair and configured to be removably worn around the pelvis, wherein the work chair includes a safety belt detachably secured to the lower portion of the cushion chair and to the front portion of the pelvis belt 20 so as to center the cushion chair on a part of the buttocks around the anus, wherein the pelvis belt includes a main pelvis belt, fixed to each of opposite sides of the upper portion of the cushion chair and removably worn around the pelvis in a horizontal direction, and an auxiliary pelvis belt, fixed to opposite sides of the lower middle portion of the cushion chair, extending in an oblique direction, and fixed to the main pelvis belt so as to be worn around the pelvis, and wherein the safety belt includes a lower-center safety belt fixed to the lower portion of the cushion chair and an upper-oblique safety belt fixed to opposite sides of the front portion of the auxiliary pelvis belt, and the lower-center safety belt and the upper-oblique safety belt are detachably fastened to each other over both thighs so that the gap between the main pelvis belt and the auxiliary pelvis belt is increased, and the cushion chair, centered on a part of the buttocks around the anus, is firmly held by a three-dimensional triangular structure formed by the main pelvis belt, the auxiliary pelvis belt and the safety belt.

The present invention, according to an aspect thereof, provides a work chair including:

a cushion chair configured to be brought into close contact with the buttocks to cushion the buttocks, a pelvis belt fixed to each of opposite sides of the cushion chair and configured to be removably worn around the pelvis, and a safety belt detachably secured to the cushion chair and to the pelvis belt, so as to center the cushion chair on a part of the buttocks around the anus, wherein the cushion chair includes a fixing ring, wherein the safety belt is fixed to the pelvis belt so as to hang down, and includes a fastening hook configured to be hooked to the fixing ring when the safety belt is worn, and wherein the pelvis belt includes a collection ring to which the fastening hook is returned upwards and hooked when the safety belt is not worn.

The present invention, according to an aspect thereof, provides a work chair including:

a cushion chair configured to be brought into close contact with the buttocks to cushion the buttocks, a pelvis belt fixed to each of opposite sides of the cushion chair and configured to be removably worn around the pelvis, and a safety belt detachably secured to the cushion chair and to the pelvis belt so as to center the cushion chair on a part of the buttocks around the anus, wherein the cushion chair includes a fixing ring, wherein the safety belt is fixed to the pelvis belt so as to hang down, and includes a fastening hook configured to be hooked to the fixing ring when used, and wherein the fixing ring is provided at each of a front surface of the cushion chair, a left surface spaced apart from the front surface to the left, and a right surface spaced apart from the front surface to the right so that the fastening hook is selectively hooked to the fixing ring provided at each of the front surface, the left surface and the right surface of the cushion chair according to the shapes of the pelvis and the thighs of a human body.

According to an aspect of the present invention, the worker fastens the pelvis belt in a lateral direction so as to wrap around the pelvis from opposite sides of the cushion chair, pulls up the lower portion of the cushion chair, and fastens the safety belt to the front portion of the pelvis belt in a vertical direction between the legs, thereby firmly centering the cushion chair on a part of the buttocks around the anus even when the worker repeatedly sits and stands or walks while squatting and eliminating the risk of falling on the buttocks during work by maintaining the cushion chair in position, thus not only maximizing convenience in use but also ensuring safety in use.

According to the present invention, when the safety belt is worn, the safety belt centers the cushion chair on a part of the buttocks around the anus, and when the safety belt is not worn, the fastening hook is returned upwards and hooked to the collection ring so that the safety belt is reduced in length, thereby protecting the worker from accidents, and preventing the safety belts from hanging down in disorder when the work chairs are stored, thus enabling storage of the work chairs in a neat and tidy manner.

According to an aspect of the present invention, the fixing band is sewn to the boundary between the bottom-surface cover member and the side-surface cover member, thereby ensuring firm fixation thereof when the safety belt is worn, thus increasing the lifespan thereof. In addition, the fixing band is further sewn to the side-surface cover member while extending upwards and then extending downwards, thereby further enhancing firmness of fixation thereof. The horizontal fixing bar is inserted into the horizontal fixing hole formed in the upper end of the fixing band so as to be rotatable in a vertical direction, thereby enabling the fastening hook to be smoothly hooked to and released from the rounded fixing bar, thus ensuring convenience in use.

According to an aspect of the present invention, the force by which the safety belt is fastened is capable of being reduced by hooking the fastening hook to the fixing ring provided at the front surface of the cushion chair, and the force by which the safety belt is fastened is capable of being increased (to be tighter around the thighs) by hooking the fastening hook to the fixing ring provided at each of the left surface and the right surface of the cushion chair, thereby enabling the worker to selectively fasten the safety belt so that the worker feels comfortable, thus maximizing convenience in use.

According to an aspect of the present invention, the collection ring is fixed to the pelvis belt together with the safety belt in a manner such that the collection band extends upwards and then extends downwards while contacting the pelvis belt, with the safety belt sandwiched therebetween, and is sewn to the pelvis belt while again extending upwards over the safety belt, thereby ensuring firm fixation of the safety belt. In addition, the horizontal collection bar of the collection ring is inserted into the horizontal collection hole formed in the lower end of the collection band so as to be rotatable in a vertical direction, thereby enabling the fasten ng hook to be smoothly hooked thereto and released therefrom, thus maximizing convenience in use.

According to an aspect of the present invention, the horizontal fastening bar of the fastening hook rotates in a vertical direction in the state of being inserted into the horizontal fastening hole, and firmly supports the rounded fastening bar, which extends from opposite ends thereof and is bent in a closed-loop shape, thereby preventing separation of the fastening hook during use and facilitating selective fastening of the fastening hook to the fixing ring or to the collection ring using the rounded fastening bar, which is rounded in an open shape, thus ensuring convenience in use.

According to an aspect of the present invention, it is possible to prevent unintended release of the fastening hook from the fixing ring or from the collection ring, thereby maintaining a more firmly fastened state.

According to an aspect of the present invention, it is possible to prevent the weft and the warp of the safety belt, which is manufactured by weaving a synthetic fiber, from becoming unwoven during use thereof.

The present invention has, according to aspects thereof, a simple structure, improves working efficiency, provides convenience in use, particularly to female workers, and more firmly holds the cushion chair, centered on a part of the buttocks around the anus, using a triangular structure formed by the pelvis belt.

DETAILED DESCRIPTION

Figure 1A:
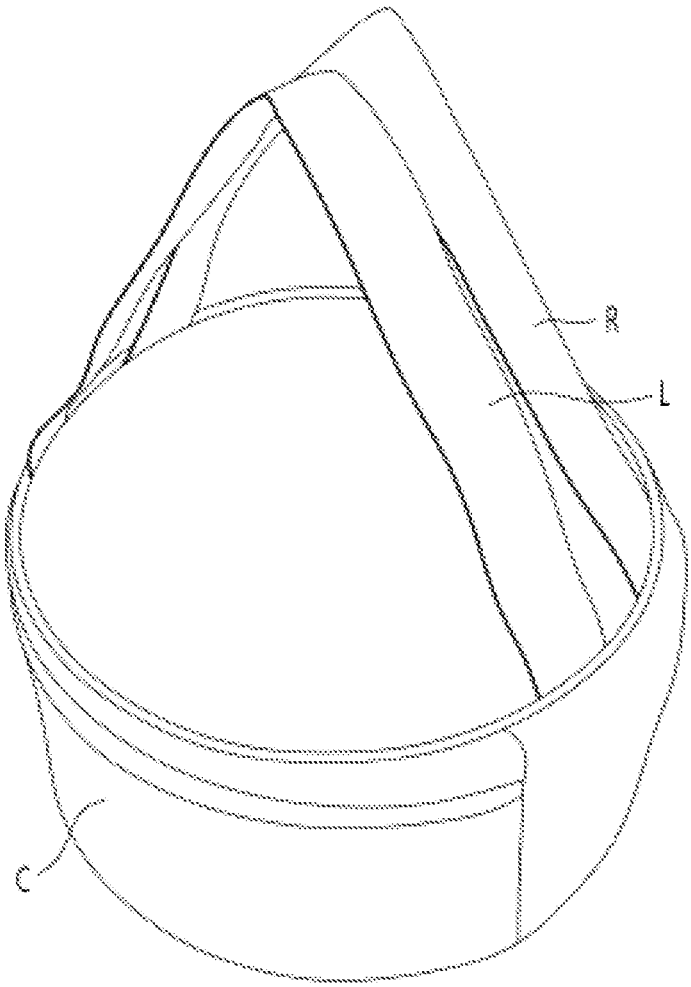
FIG. 1A shows a picture showing a work chair according to Conventional Art Document 1.
Figure 1B:
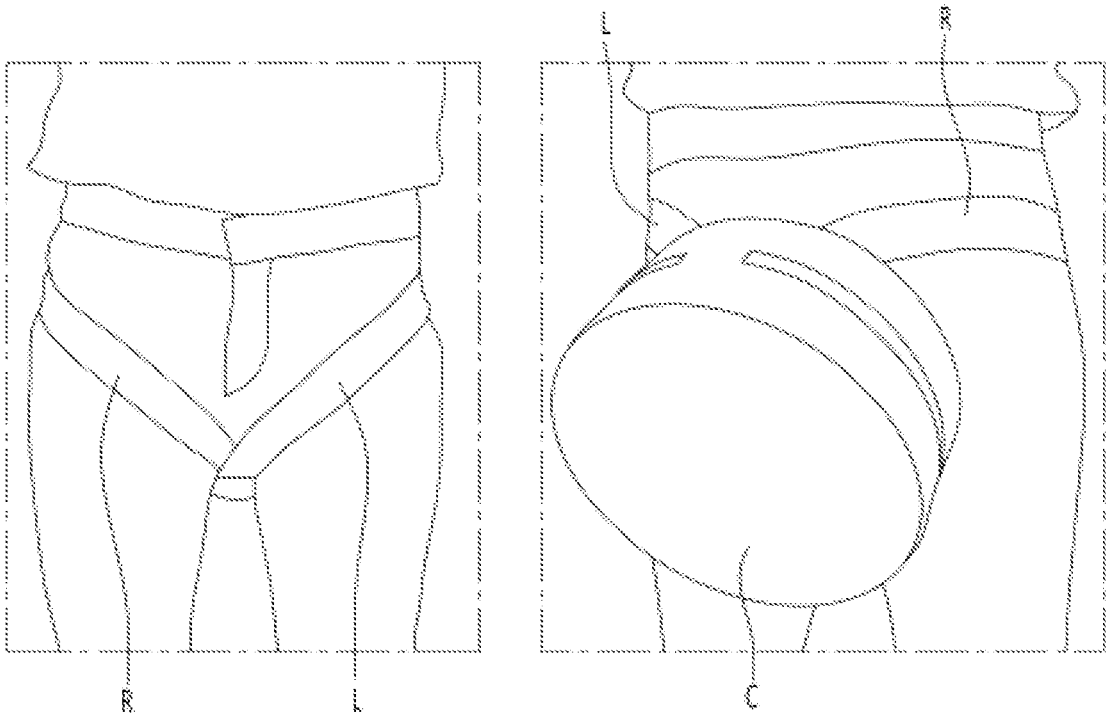
FIG. 1B shows pictures showing the state in which a work chair of the same type as that in Conventional Art Document 1 is used when viewed from the front and the rear.
Figure 1C:
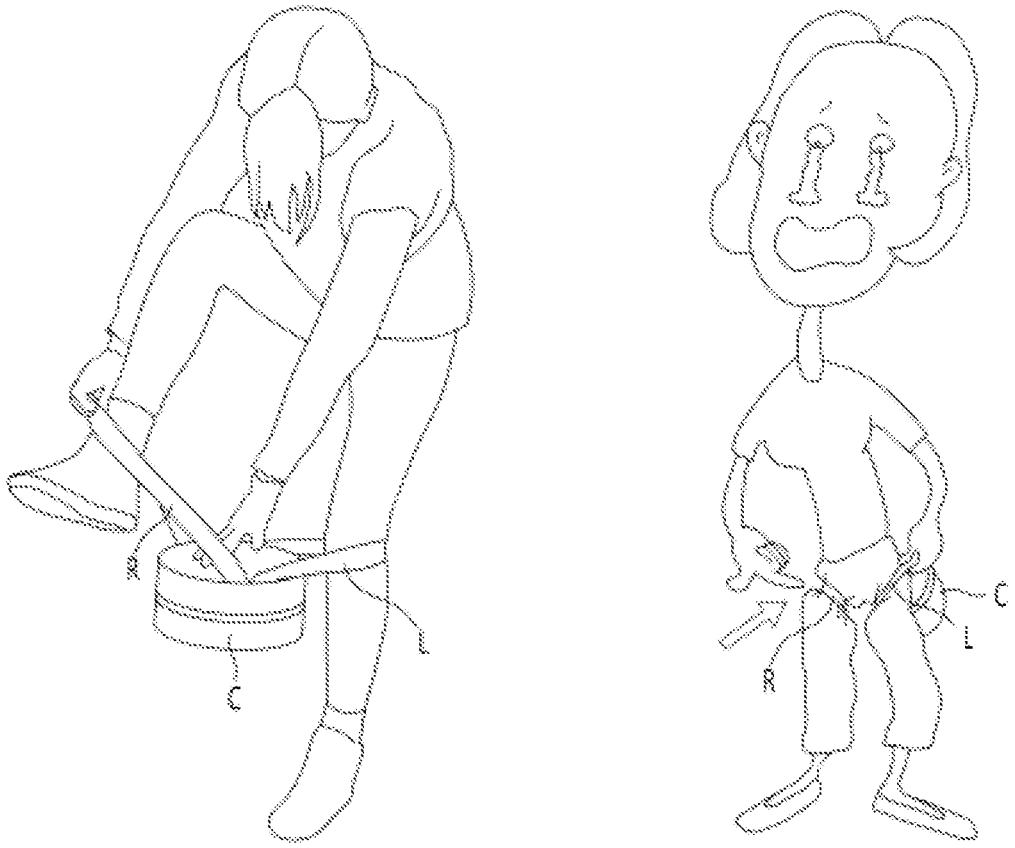
FIG. 1C shows a picture and an image respectively showing the method of using a work chair of the same type as that in Conventional Art Document 1 and the state of use of the work chair.
Figure 2A:
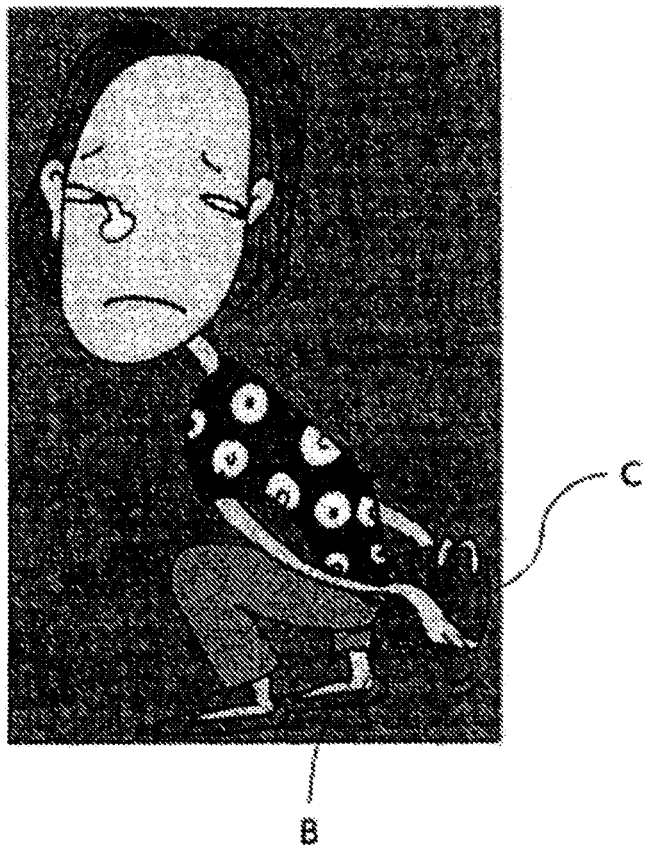
FIGS. 2A and 2B are images showing the state of use of a work chair disclosed as the conventional art in Conventional Art Document 2 (U.S. Pat. No. 1,562,177).
Figure 2B:
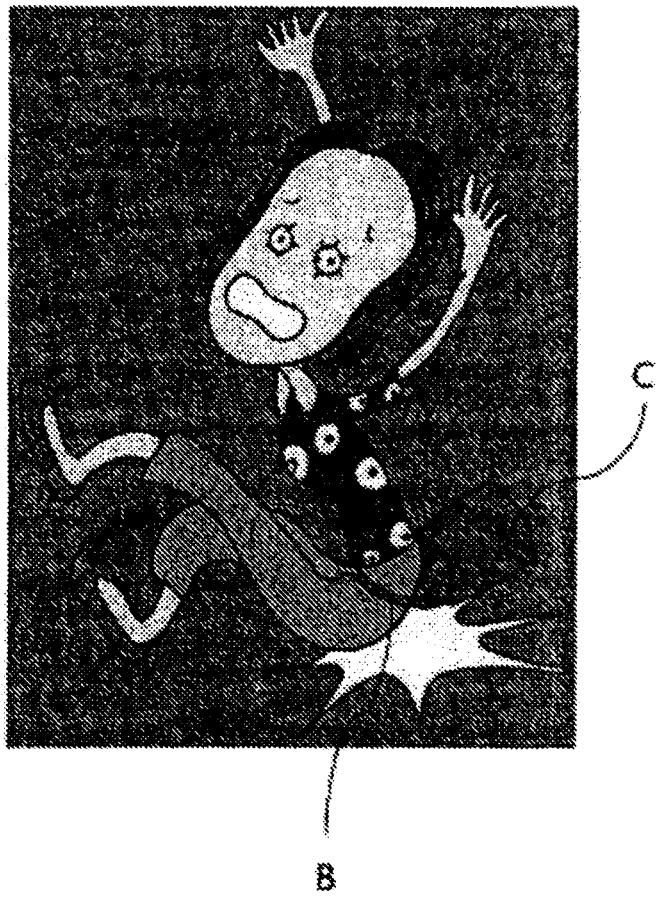

A mode for carrying out the present invention is directed to:

a work chair including a cushion chair 10 configured to be brought into close contact with the buttocks to cushion the buttocks and a pelvis belt 20 fixed to each of opposite sides of the cushion chair 10 and configured to be removably worn around the pelvis, wherein the work chair includes a safety belt 30 detachably secured to the lower portion of the cushion chair 10 and to the front portion of the pelvis belt 20 so as to center the cushion chair 10 on a part of the buttocks around the anus, wherein the safety belt 30 is fixed to the lower portion of the cushion chair 10 and is detachably fastened to the front portion of the pelvis belt 20, wherein the pelvis belt 20 includes a main pelvis belt 21, fixed to each of opposite sides of the upper portion of the cushion chair 10 and removably worn around the pelvis in a horizontal direction, and an auxiliary pelvis belt 22, fixed to opposite sides of the lower middle portion of the cushion chair 10, extending in an oblique direction, and fixed to the main pelvis belt 21 so as to be worn around the pelvis, and wherein the safety belt 30 is fixed to the lower portion of the cushion chair 10 and is detachably fastened to opposite sides of the front portion of the auxiliary pelvis belt 22 over both thighs so that a gap between the main pelvis belt 21 and the auxiliary pelvis belt 22 is increased, and the cushion chair 10, centered on a part of the buttocks around the anus, is firmly held by the three-dimensional triangular structure formed by the main pelvis belt 21, the auxiliary pelvis belt 22 and the safety belt 30.

Exemplary embodiments of a work chair according to the present invention will be described with reference to the accompanying drawings. A plurality of embodiments may be present, and the features and advantages of the present invention can be fully understood by way of such embodiments.

FIGS. 3A to 12B are perspective views showing work chairs according to respective embodiments of the present invention and views showing the state of use of the same.

As shown in FIGS. 3A to 12B, the work chair according to the present invention basically includes a cushion chair 10, which is brought into close contact with the buttocks to cushion the same, and a pelvis belt 20, which is fixed to each of opposite sides of the cushion chair 10 and is removably worn around the pelvis.

The cushion chair 10 may be manufactured by inserting a cushion material such as Styrofoam into a cover member, which is provided with a zipper on the side surface thereof so as to be opened or closed, and may be formed in a cylindrical shape or a semi-cylindrical shape. The pelvis belt 20 may be fixed to each of opposite sides of the cushion chair 10, and may be provided with a strip of Velcro tape 20*a* (named after the trademark Velcro), which is also called a hook-and-loop fastener, or with a buckle so as to be elastically and removably worn around the pelvis.

In the state in which the pelvis belt 20 fixed to each of opposite sides of the cushion chair 10 is worn around the pelvis, when the worker repeatedly sits and stands or walks while squatting during work, the cushion chair 10 may ascend above the tailbone or may shift to the left or the right of the buttocks, which may cause the worker to stop performing the main task in order to realign the cushion chair 10.

In consideration of this problem, the present invention includes, as an essential component, a safety belt 30, which is detachably secured to the lower portion of the cushion chair 10 and to the front portion of the pelvis belt 20 so that the cushion chair 10 is centered on a part of the buttocks around the anus.

The worker fastens the pelvis belt 20 in a lateral direction so as to wrap around the pelvis from opposite sides of the cushion chair 10, pulls up the lower portion of the cushion chair 10, and fastens the safety belt 30 to the front portion of the pelvis belt 20 in a vertical direction between the legs, thereby firmly centering the cushion chair 10 on a part of the buttocks around the anus even when the worker repeatedly sits and stands or walks while squatting and eliminating the risk of falling on the buttocks during work by maintaining the cushion chair 10 in position, thus not only maximizing convenience in use but also ensuring safety in use (of course, in this case, the safety belt 30 may also be made of an elastic material).

Figure 3A:
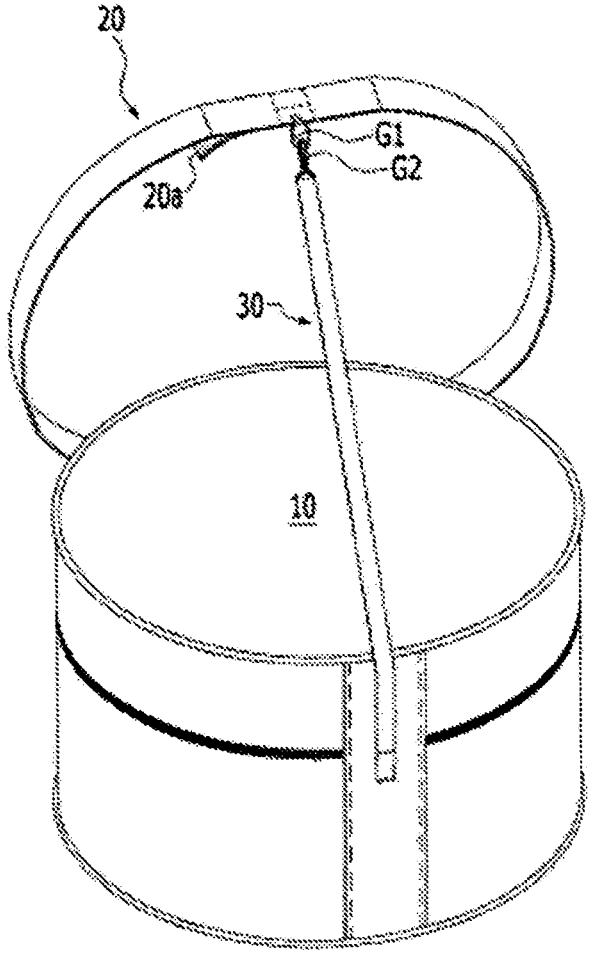
FIG. 3A is a perspective view showing a work chair according to a first embodiment of the present invention.
Figure 3B:
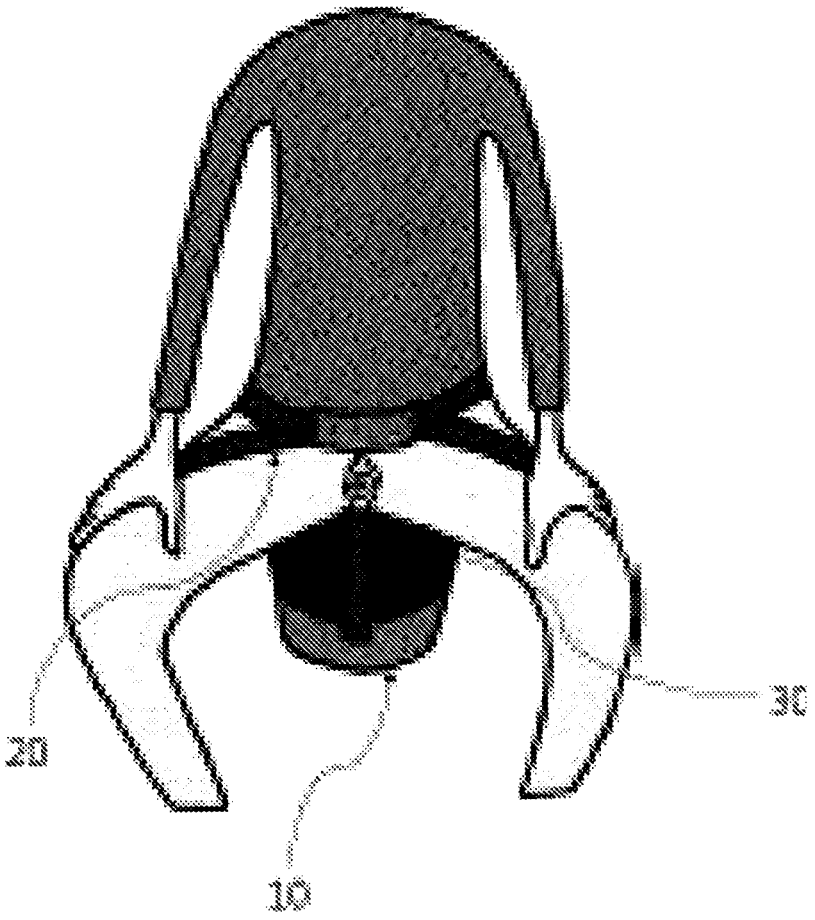
FIG. 3B is a view showing the state of use of the work chair according to the first embodiment of the present invention.
Figure 4A:
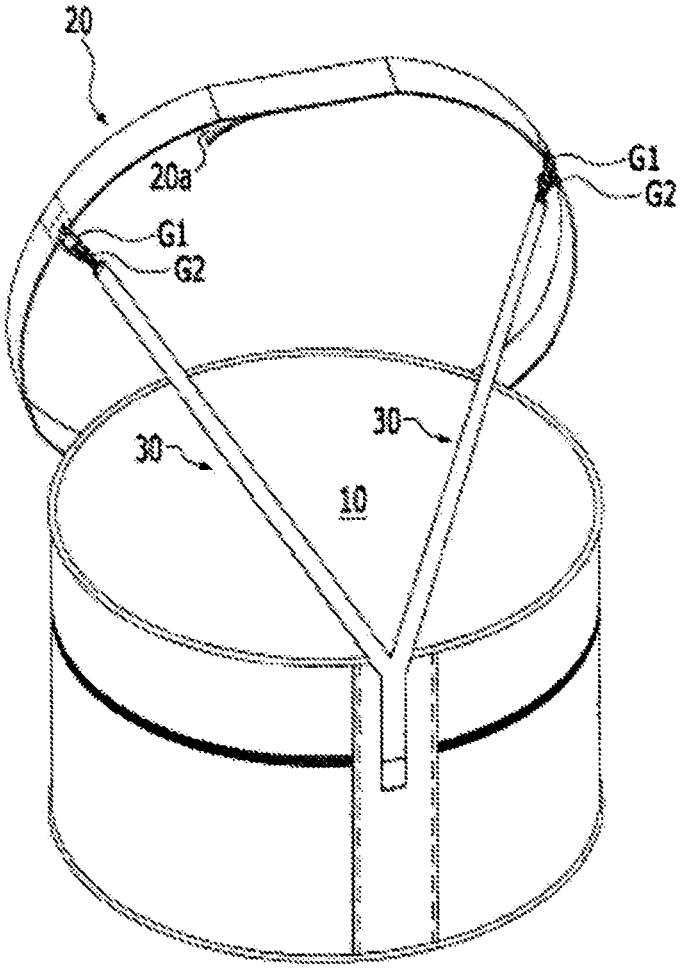
FIG. 4A is a perspective view showing a work chair according to a second embodiment of the present invention.
Figure 4B:
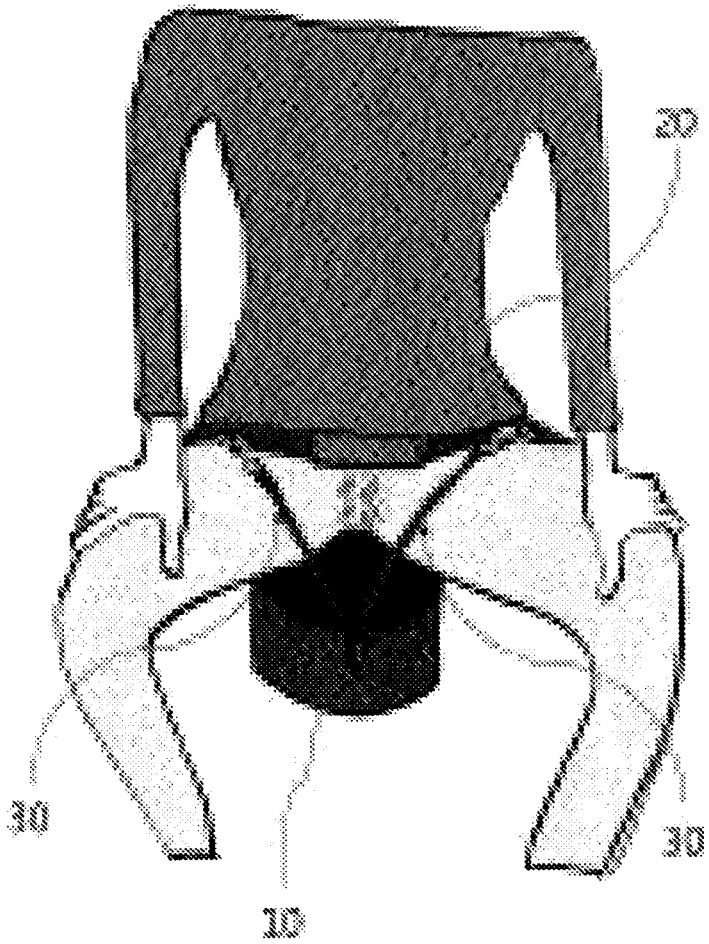
FIG. 4B is a view showing the state of use of the work chair according to the second embodiment of the present invention.
Figure 5A:
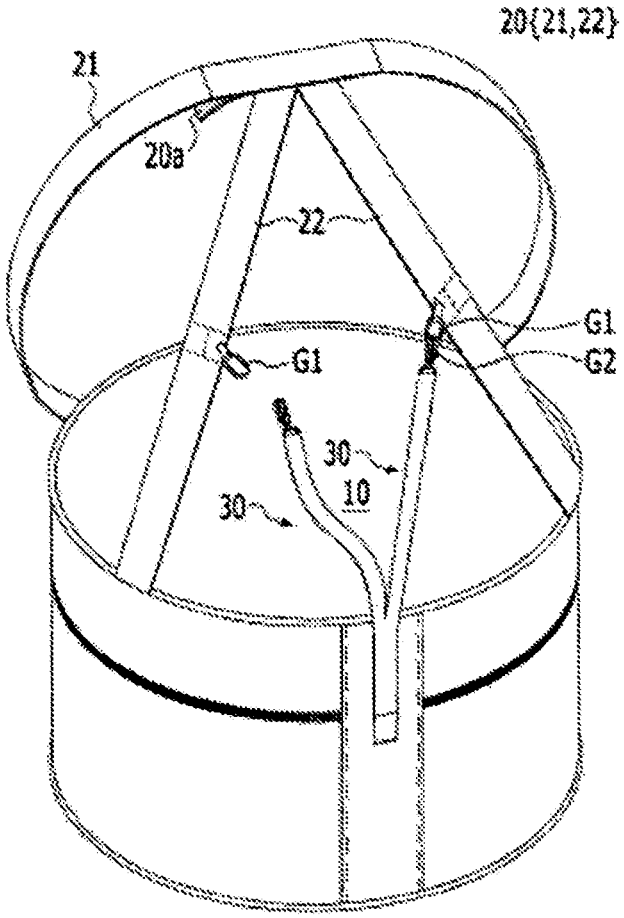
FIG. 5A is a perspective view showing a work chair according to a third embodiment of the present invention.
Figure 5B:
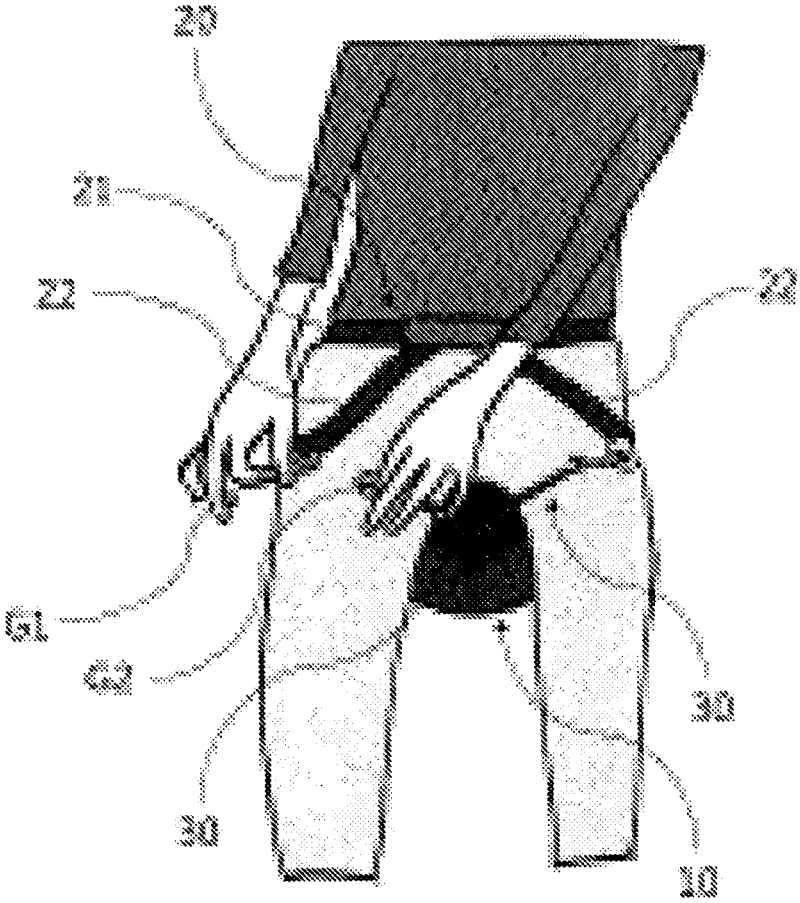
FIG. 5B is a view showing the state of use of the work chair according to the third embodiment of the present invention.

FIG. 3A is a perspective view showing a work chair according to a first embodiment of the present invention, FIG. 3B is a view showing the state of use of the work chair according to the first embodiment of the present invention, FIG. 4A is a perspective view showing a work chair according to a second embodiment of the present invention, FIG. 4B is a view showing the state of use of the work chair according to the second embodiment of the present invention, FIG. 5A is a perspective view showing a work chair according to a third embodiment of the present invention, and FIG. 5B is a view showing the state of use of the work chair according to the third embodiment of the present invention.

According to the first to third embodiments of the present invention, as shown in FIGS. 3A to 5B, the safety belt 30 is fixed to the lower portion of the cushion chair 10 and is capable of being detachably fastened to the front portion of the pelvis belt 20.

If the worker does not wear the safety belt 30, which is fixed to the lower portion of the cushion chain 10, the safety belt 30 drags on the ground, which forces the worker to fasten the safety belt 30 to the front portion of the pelvis belt 20, thereby ensuring a safer work environment.

As shown in FIGS. 3A and 3B, according to the first embodiment of the present invention, the safety belt 30 is fixed to the lower portion of the cushion chair 10 and is capable of being detachably fastened to the center of the front portion of the pelvis belt 20 through the crotch.

The embodiment is preferable in that it has a simple structure, improves working efficiency, and provides convenience in use, particularly to female workers, because the safety belt 30 pulls the lower portion of the cushion chair 10 upwards and is detachably fastened to the center of the front portion of the pelvis belt 20 through the crotch.

As shown in FIGS. 4A and 4B, according to the second embodiment of the present invention, the safety belt 30 is fixed to the lower portion of the cushion chair 10 and is capable of being detachably fastened to opposite sides of the front portion of the pelvis belt 20 over both thighs.

The embodiment is preferable in that the cushion chair 10, centered on a part of the buttocks around the anus, is more firmly held by the triangular structure formed by the pelvis belt 20 and the safety belt 30, because the safety belt 30 pulls the lower portion of the cushion chair 10 upwards and is detachably fastened to opposite sides of the front portion of the pelvis belt 20 over both thighs.

As shown in FIGS. 5A and 5B, according to the third embodiment of the present invention, the pelvis belt 20 may include a main pelvis belt 21, which is fixed to each of opposite sides of the upper portion of the cushion chair 10 and is removably worn around the pelvis in a horizontal direction, and an auxiliary pelvis belt 22, which is fixed to opposite sides of the lower middle portion of the cushion chair 10, extends in an oblique direction, and is fixed to the main pelvis belt 21 so as to be worn around the pelvis. The safety belt 30 may be fixed to the lower portion of the cushion chair 10, and is capable of being detachably fastened to opposite sides of the front portion of the auxiliary pelvis belt 22 over both thighs.

The embodiment is preferable in that the gap between the main pelvis belt 21 and the auxiliary pelvis belt 22 is increased, and the cushion chair 10, centered on a part of the buttocks around the anus, is much more firmly held by the three-dimensional triangular structure formed by the main pelvis belt 21, the auxiliary pelvis belt 22 and the safety belt 30, because the main pelvis belt 21 and the auxiliary pelvis belt 22 are wrapped around the pelvis, thereby more stably centering the cushion chair 10 on a part of the buttocks around the anus, and the safety belt 30 pulls the lower portion of the cushion chair 10 upwards and is detachably fastened to opposite sides of the front portion of the auxiliary pelvis belt 22 over both thighs.

Figure 6A:
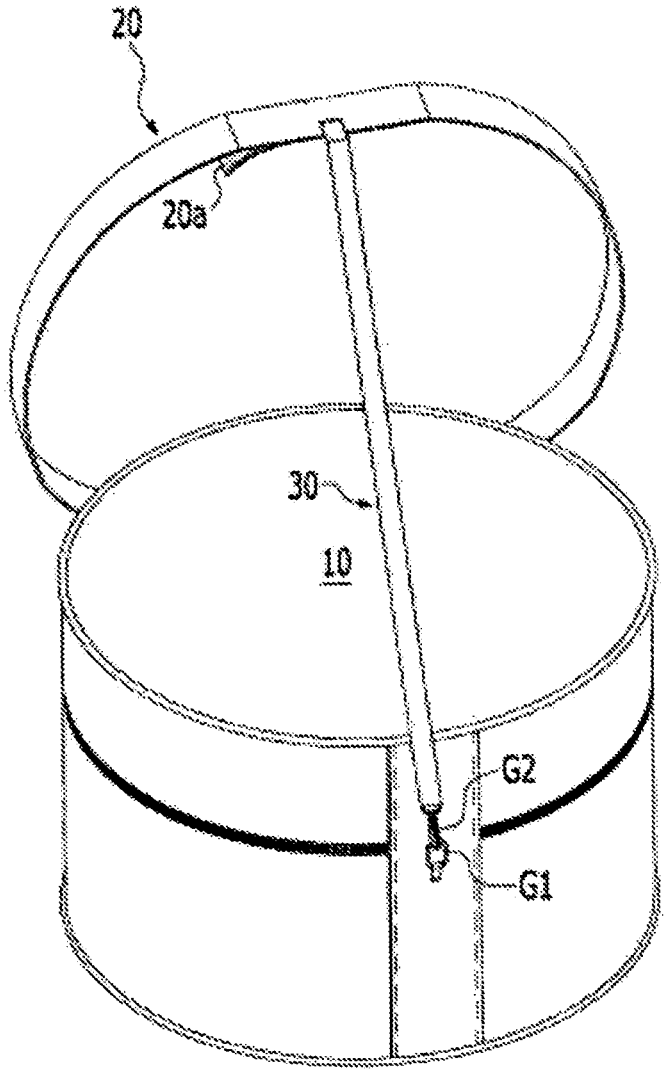
FIG. 6A is a perspective view showing a work chair according to a fourth embodiment of the present invention.
Figure 6B:
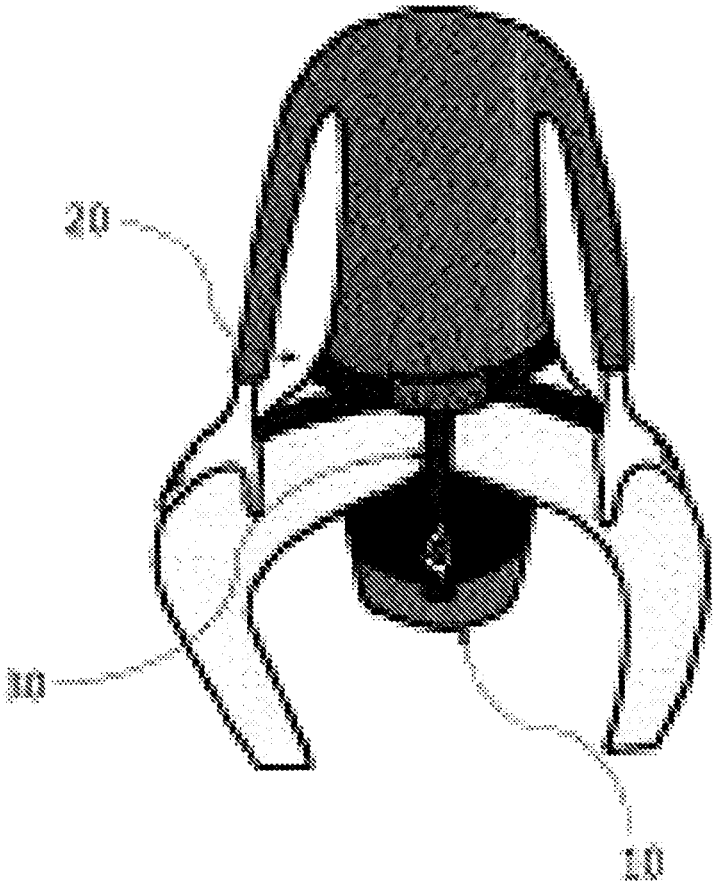
FIG. 6B is a view showing the state of use of the work chair according to the fourth embodiment of the present invention.
Figure 7A:
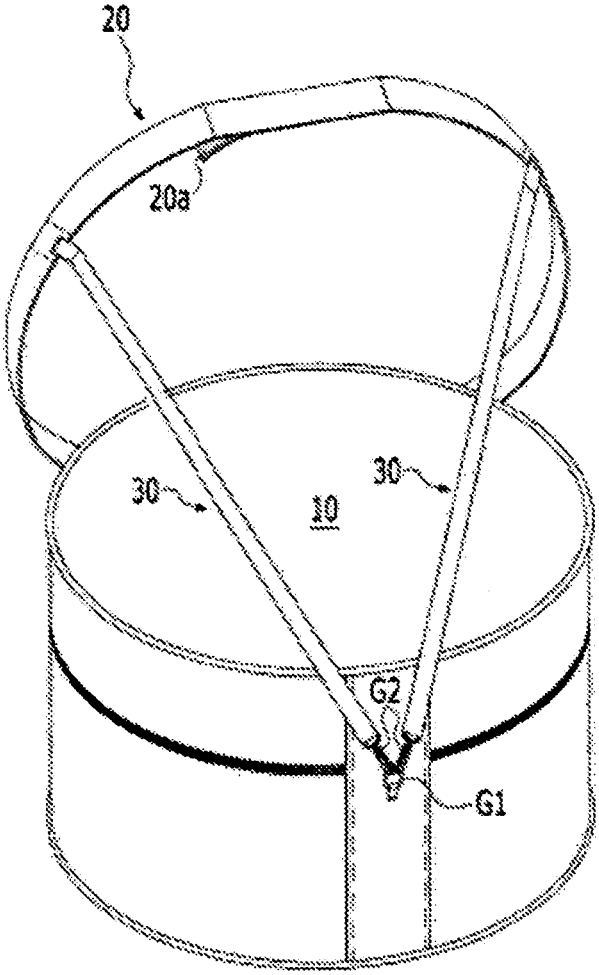
FIG. 7A is a perspective view showing a work chair according to a fifth embodiment of the present invention.
Figure 7B:
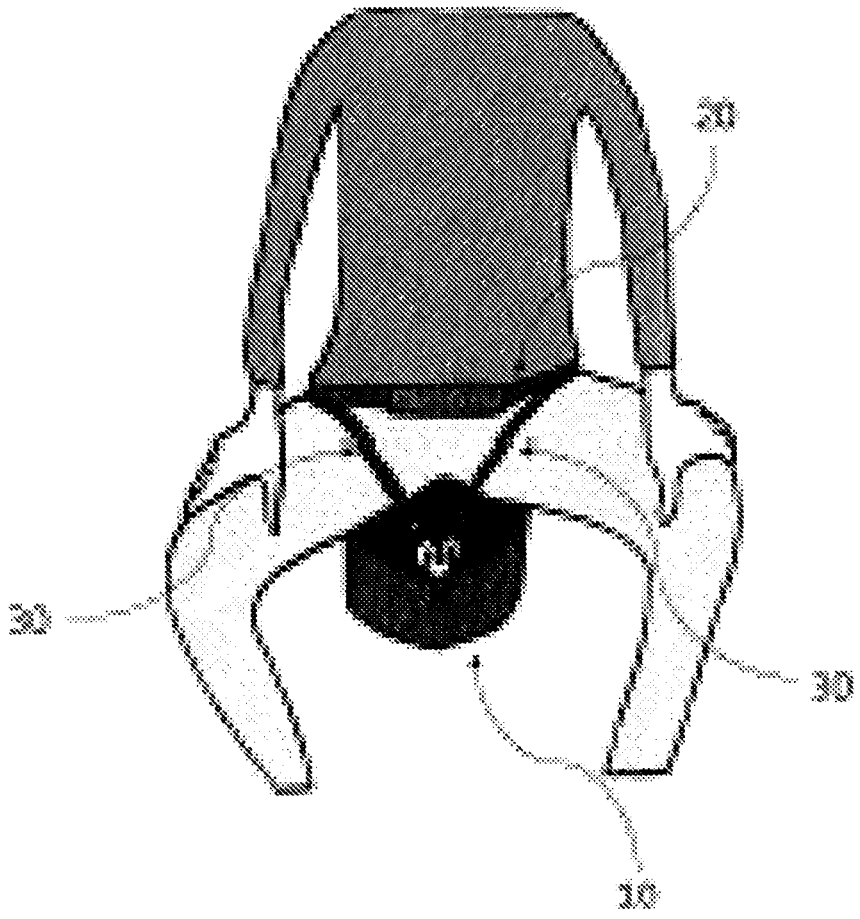
FIG. 7B is a view showing the state of use of the work chair according to the fifth embodiment of the present invention.
Figure 8A:
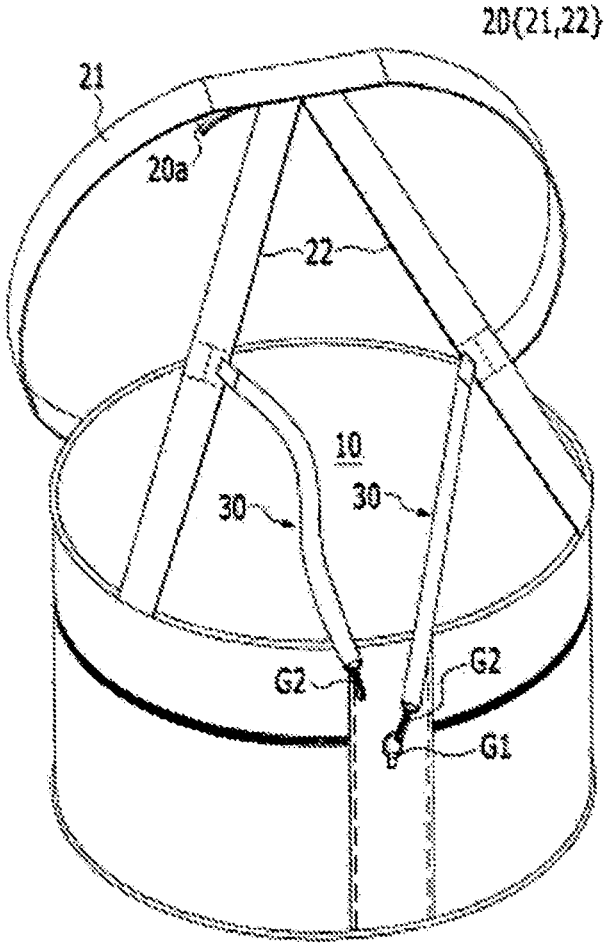
FIG. 8A is a perspective view showing a work chair according to a sixth embodiment of the present invention.
Figure 8B:
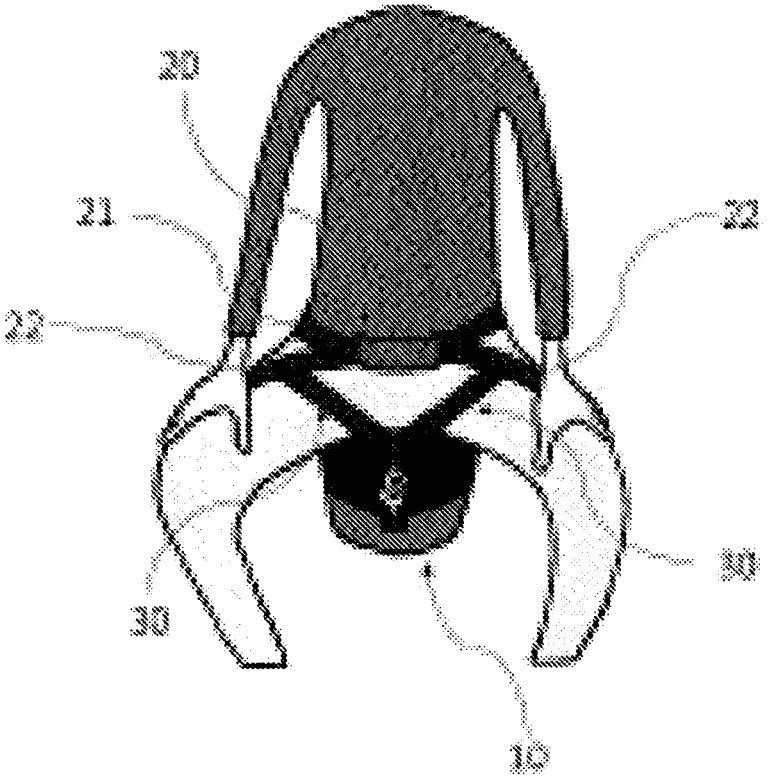
FIG. 8B is a view showing the state of use of the work chair according to the sixth embodiment of the present invention.

FIG. 6A is a perspective view showing a work chair according to a fourth embodiment of the present invention, FIG. 6B is a view showing the state of use of the work char according to the fourth embodiment of the present invention, FIG. 7A is a perspective view showing a work chair according to a fifth embodiment of the present invention, FIG. 7B is a view showing the state of use of the work chair according to the fifth embodiment of the present invention, FIG. 8A is a perspective view showing a work chair according to a sixth embodiment of the present invention, and FIG. 8B is a view showing the state of use of the work chair according to the sixth embodiment of the present invention.

According to the fourth to sixth embodiments of the present invention, as shown in FIGS. 6A to 8B, the safety belt 30 is fixed to the front portion of the pelvis belt 20 and is capable of being detachably fastened to the lower portion of the cushion chair 10.

The configuration in which the safety belt 30 is fixed to the front portion of the pelvis belt 20 is preferable, because the worker is capable of performing any work in the state in which the safety belt 30 hangs down in front of the pelvis belt 20 even when the worker does not wear the safety belt 30 according to the worker's preference or work environment (in which it is required to quickly take off the work chair).

As shown in FIGS. 6A and 6B, according to the fourth embodiment of the present invention, the safety belt 30 is fixed to the center of the front portion of the pelvis belt 20 and is capable of being detachably fastened to the lower portion of the cushion chair 10 through the crotch.

The embodiment is preferable in that it has a simple structure, improves working efficiency, and provides convenience in use, particularly to female workers, because the safety belt 30 is fixed to the center of the front portion of the pelvis belt 20 and is detachably fastened to the lower portion of the cushion chair 10 through the crotch.

As shown in FIGS. 7A and 7B, according to the fifth embodiment of the present invention, the safety belt 30 is fixed to opposite sides of the front portion of the pelvis belt 20 and is capable of being detachably fastened to the lower portion of the cushion chair 10.

The embodiment is preferable in that the cushion chair 10, centered on a part of the buttocks around the anus, is more firmly held by the triangular structure formed by the pelvis belt 20 and the safety belt 30, because the safety belt 30 is fixed to opposite sides of the front portion of the pelvis belt 20 and is detachably fastened to the lower portion of the cushion chair 10 over both thighs.

As shown in FIGS. 8A and 8B, according to the sixth embodiment of the present invention, the pelvis belt 20 may include a main pelvis belt 21, which is fixed to each of opposite sides of the upper portion of the cushion chair 10 and is removably worn around the pelvis in a horizontal direction, and an auxiliary pelvis belt 22, which is fixed to opposite sides of the lower middle portion of the cushion chair 10, extends in an oblique direction, and is fixed to the main pelvis belt 21 so as to be worn around the pelvis. The safety belt 30 may be fixed to opposite sides of the front portion of the auxiliary pelvis belt 22, and is capable of being detachably fastened to the lower portion of the cushion chair 10.

The embodiment is preferable in that the gap between the main pelvis belt 21 and the auxiliary pelvis belt 22 is increased, and the cushion chair 10, centered on a part of the buttocks around the anus, is much more firmly held by the three-dimensional triangular structure formed by the main pelvis belt 21, the auxiliary pelvis belt 22 and the safety belt 30, because the main pelvis belt 21 and the auxiliary pelvis belt 22 are wrapped around the pelvis, thereby more stably centering the cushion chair 10 on a part of the buttocks around the anus, and the safety belt 30 is fixed to opposite sides of the front portion of the auxiliary pelvis belt 22 and is capable of being detachably fastened to the lower portion of the cushion chair 10 over both thighs.

Figure 9A:
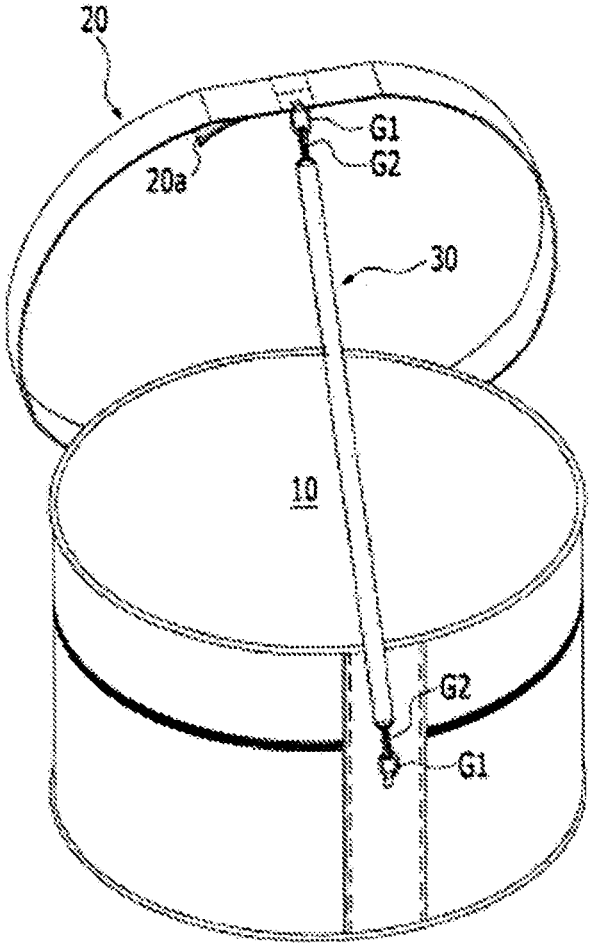
FIG. 9A is a perspective view showing a work chair according to a seventh embodiment of the present invention.
Figure 9B:
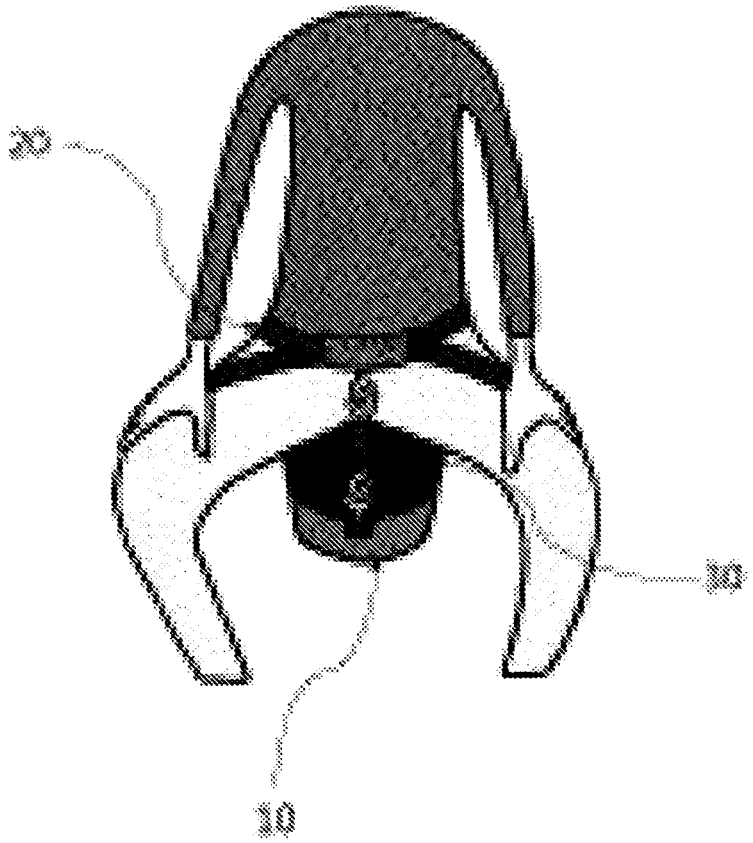
FIG. 9B is a view showing the state of use of the work chair according to the seventh embodiment of the present invention.
Figure 10A:
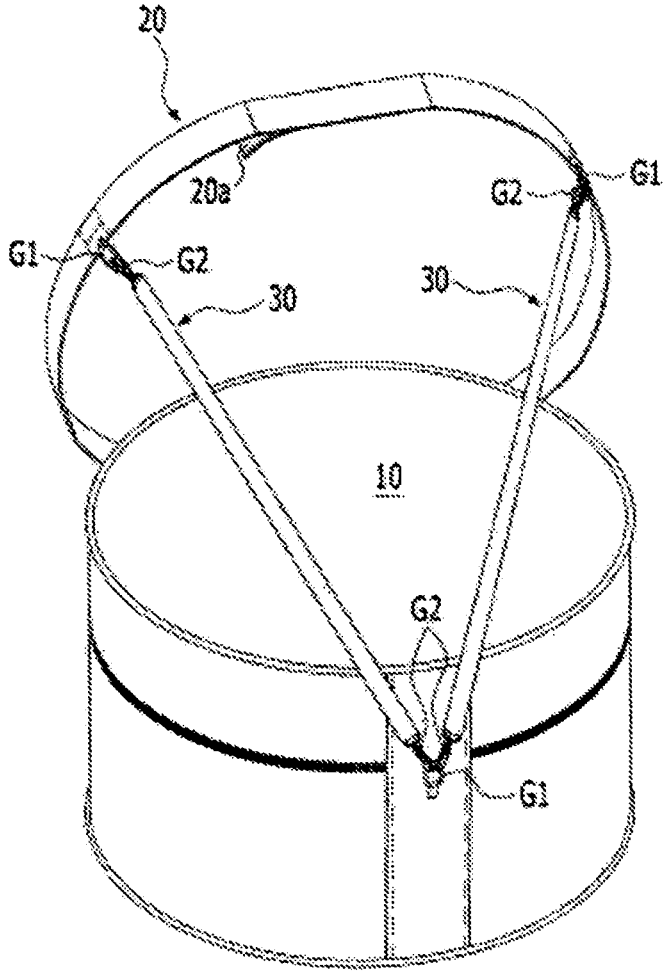
FIG. 10A is a perspective view showing a work chair according to an either embodiment of the present invention.
Figure 10B:
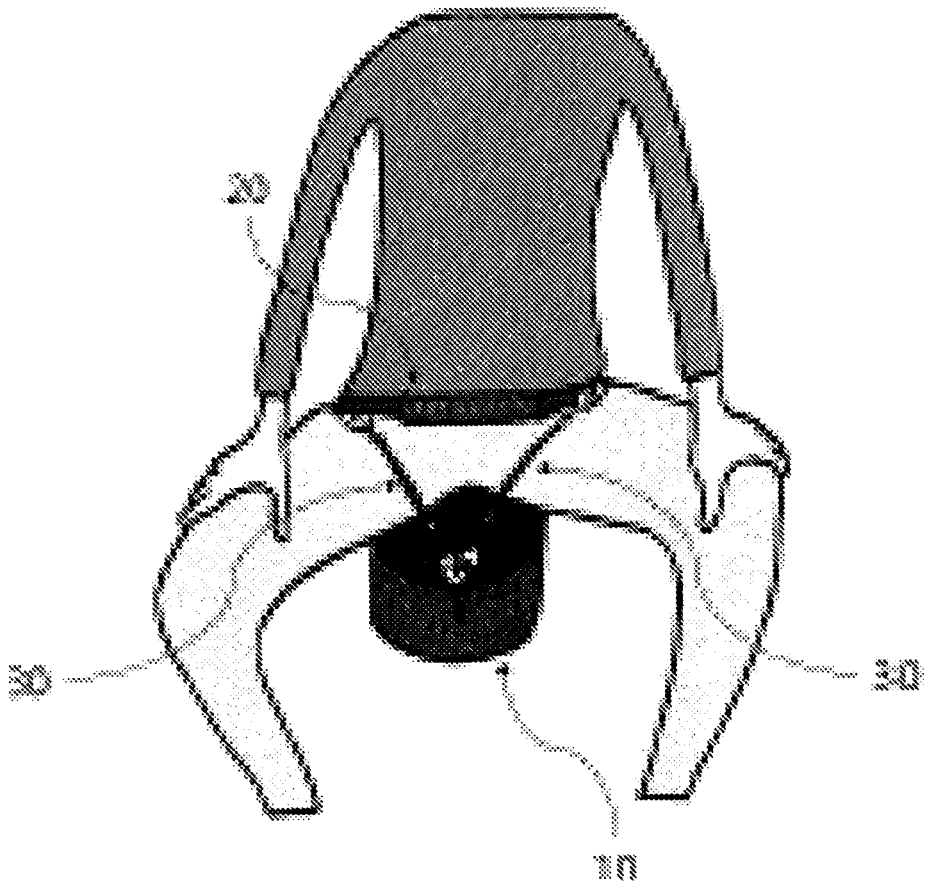
FIG. 10B is a view showing the state of use of the work chair according to the eighth embodiment of the present invention.
Figure 11A:
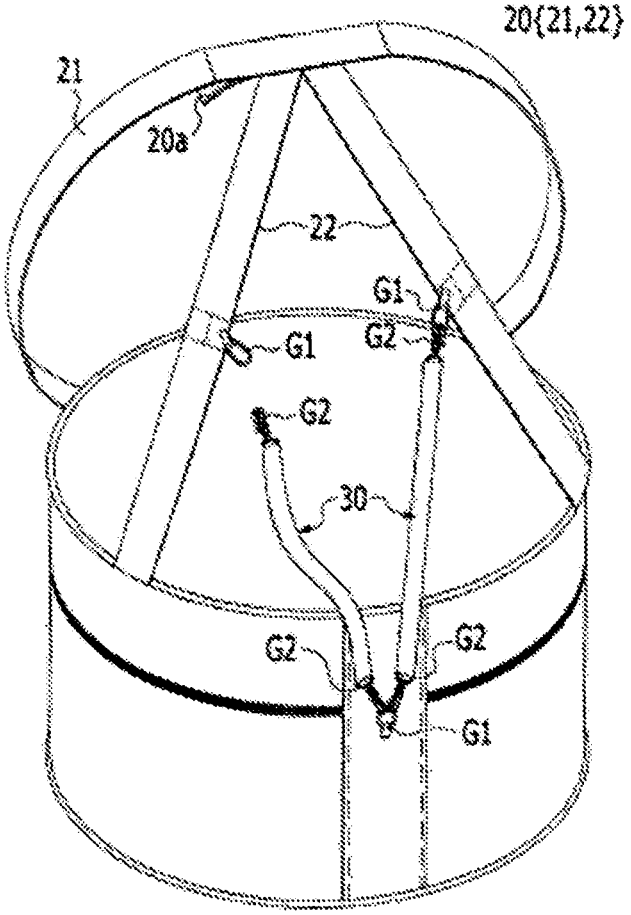
FIG. 11A is a perspective view showing a work chair according to a ninth embodiment of the present invention.
Figure 11B:
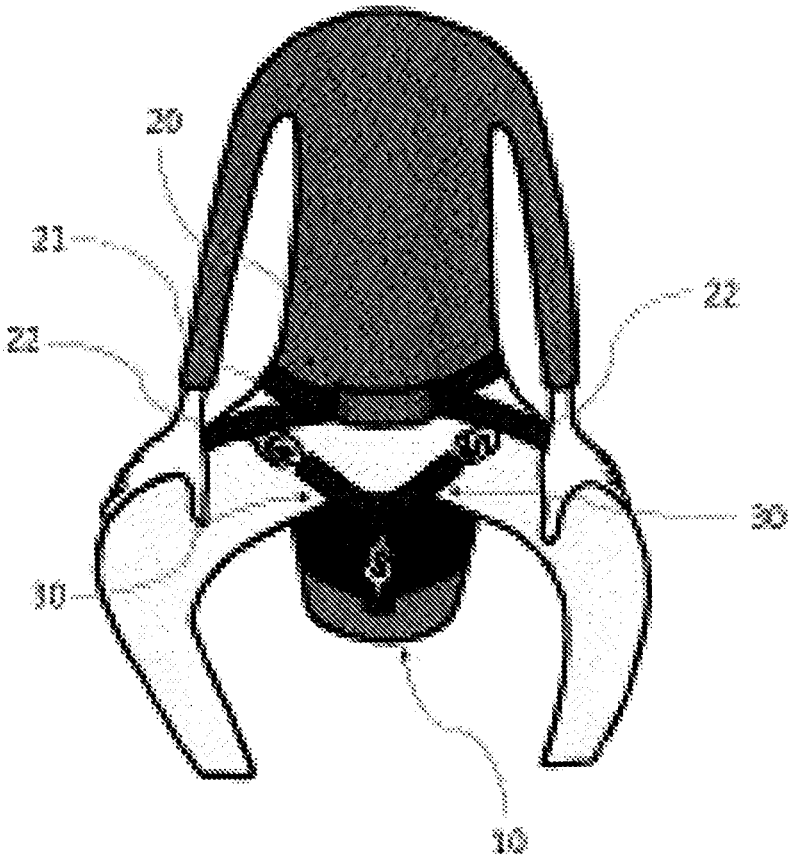
FIG. 11B is a view showing the state of use of the work chair according to the ninth embodiment of the present invention.

FIG. 9A is a perspective view showing a work chair according to a seventh embodiment of the present invention, FIG. 9B is a view showing the state of use of the work chair according to the seventh embodiment of the present invention, FIG. 10A is a perspective view showing a work chair according to an eighth embodiment of the present invention, FIG. 10B is a view showing the state of use of the work chair according to the eighth embodiment of the present invention, FIG. 11A is a perspective view showing a work chair according to a ninth embodiment of the present invention, and FIG. 11B is a view showing the state of use of the work chair according to the ninth embodiment of the present invention.

According to the seventh to ninth embodiments of the present invention, as shown in FIGS. 9A to 11B, the safety belt 30 is capable of being detachably fastened both to the lower portion of the cushion chair 10 and to the front portion of the pelvis belt 20.

The configuration in which the safety belt 30 is detachably fastened both to the lower portion of the cushion chair 10 and to the front portion of the pelvis belt 20 is more preferable, because the worker is capable of freely replacing a safety belt 30 that is reduced in elasticity or is damaged during use, is additionally capable of freely selecting a safety belt 30 suitable for the size of the pelvis, and is additionally capable of selecting a safety belt 30 that is containable for the worker.

As shown in FIGS. 9A and 9B, according to the seventh embodiment of the present invention, the safety belt 30 is capable of being detachably fastened to the lower portion of the cushion chair 10 and to the front portion of the pelvis belt 20 through the crotch.

The embodiment is preferable in that it enables free detachment of the safety belt 30 as needed, has a simple structure, improves working efficiency, and provides convenience in use, particularly to female workers, because the safety belt 30 is detachably fastened to the lower portion of the cushion chair 10 and to the center of the front portion of the pelvis belt 20 through the crotch.

As shown in FIGS. 10A and 10B, according to the eighth embodiment of the present invention, the safety belt 30 is capable of being detachably fastened to the lower portion of the cushion chair 10 and to opposite sides of the front portion of the pelvis belt 20 over both thighs.

The embodiment is preferable in that the safety belt 30 is capable of being freely detached as needed and the cushion chair 10, centered on a part of the buttocks around the anus, is more firmly held by the triangular structure formed by the pelvis belt 20 and the safety belt 30, because the safety belt 30 is detachably fastened to the lower portion of the cushion chair 10 and to opposite sides of the front portion of the pelvis belt 20 over both thighs.

As shown in FIGS. 11A and 11B, according to the ninth embodiment of the present invention the pelvis belt 20 may include a main pelvis belt 21, which is fixed to each of opposite sides of the upper portion of the cushion chair 10 and is removably worn around the pelvis in a horizontal direction, and an auxiliary pelvis belt 22, which is fixed to opposite sides of the lower middle portion of the cushion chair 10, extends in an oblique direction, and is fixed to the main pelvis belt 21 so as to be worn around the pelvis. The safety belt 30 may be detachably fastened to the lower portion of the cushion chair 10 and to opposite sides of the front portion of the auxiliary pelvis belt 22 over both thighs.

The embodiment is preferable in that the safety belt 30 is capable of being freely detached as needed, the gap between the main pelvis belt 21 and the auxiliary pelvis belt 22 is increased, and the cushion chair 10, centered on a part of the buttocks around the anus, is much more firmly held by the three-dimensional triangular structure formed by the main pelvis belt 21, the auxiliary pelvis belt 22 and the safety belt 30, because the main pelvis belt 21 and the auxiliary pelvis belt 22 are wrapped around the pelvis, thereby more stably centering the cushion chair 10 on a part of the buttocks around the anus, and the safety belt 30 is detachably fastened to the lower portion of the cushion chair 10 and to opposite sides of the front portion of the auxiliary pelvis belt 22 over both thighs.

Figure 12A:
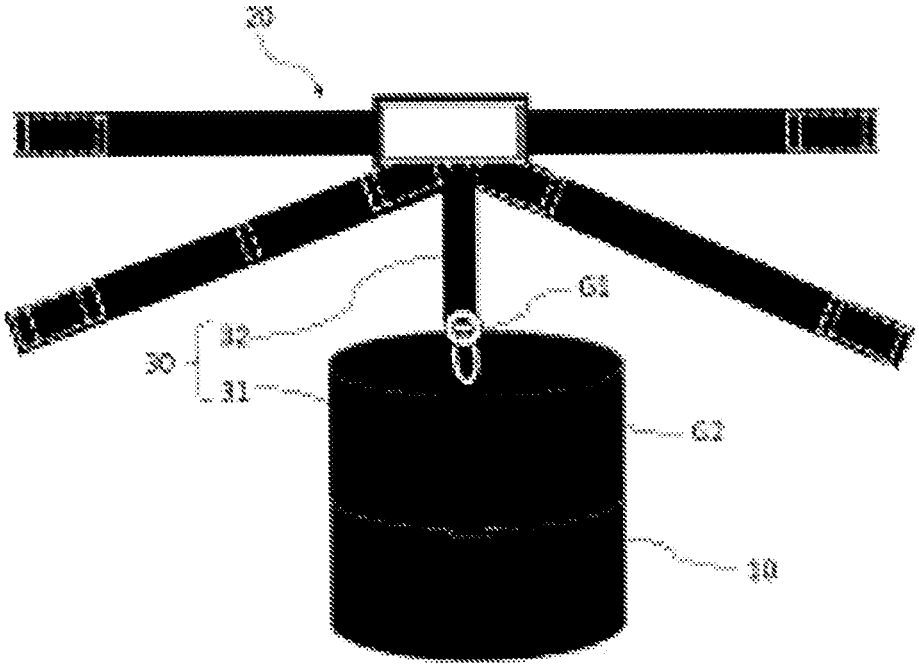
FIG. 12A is an exploded development view showing a work chair according to a tenth embodiment of the present invention.
Figure 12B:
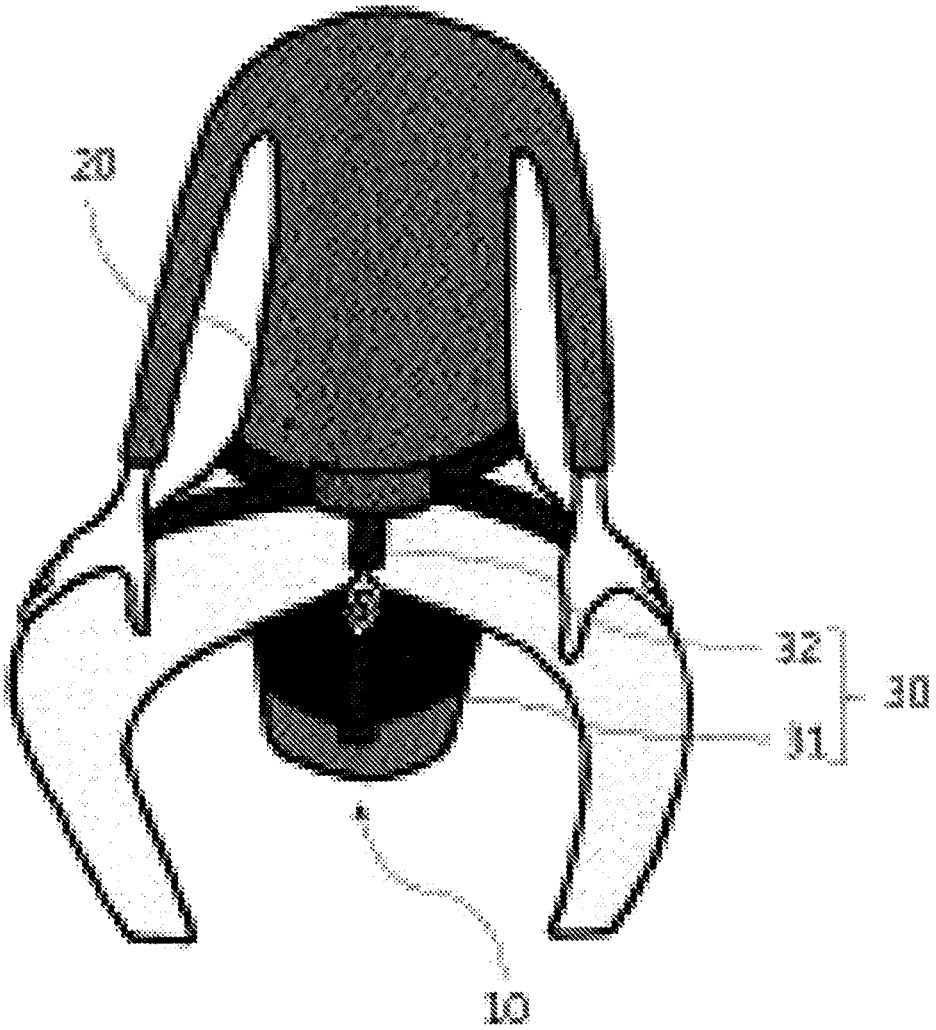
FIG. 12B is a view showing the state of use of the work chair according to the tenth embodiment of the present invention.

FIG. 12A is an exploded development view showing a work chair according to a tenth embodiment of the present invention, and FIG. 12B is a view showing the state of use of the work chair according to the tenth embodiment of the present invention.

As shown in FIGS. 12A and 12B, the safety belt 30 according to the tenth embodiment of the present invention includes a lower-half safety belt 31, which is fixed to the lower portion of the cushion chair 10, and an upper-half safety belt 32, which is fixed to the center of the front portion of the pelvis belt 20 and is detachably fastened to the lower-half safety belt 31 through the crotch.

The embodiment, in which the safety belt 30 includes the lower-half safety belt 31 fixed to the lower portion of the cushion chair 10 and the upper-half safety belt 32 fixed to the center of the front portion of the pelvis belt 20, is preferable in that the worker is capable of more easily fastening the safety belt 30 merely by pulling the lower-half safety belt 31 upwards and fastening the upper-half safety belt 32 thereto, and is also capable of simply detaching the safety belt 30 in the reverse order thereto.

Figure 13A:
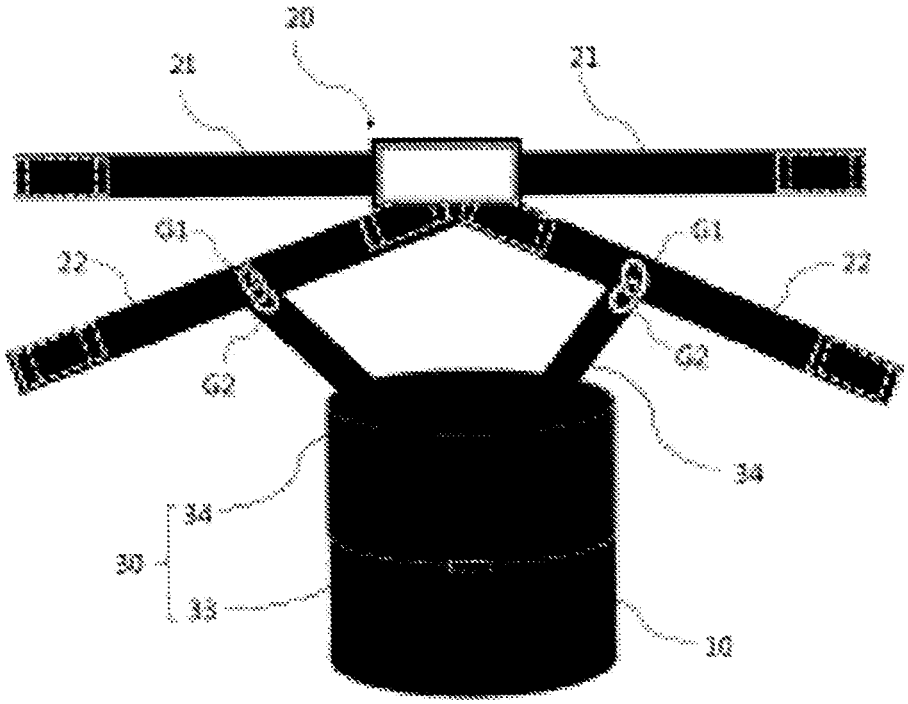
FIG. 13A is an exploded development view showing a work chair according to an eleventh embodiment of the present invention.
Figure 13B:
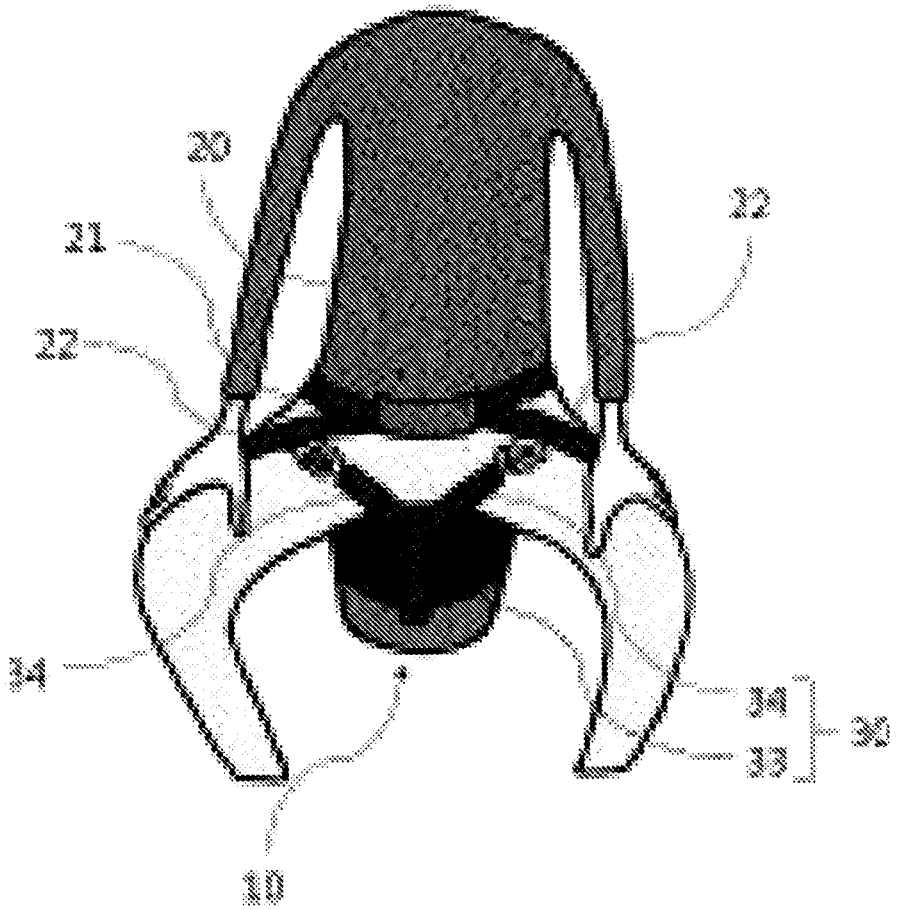
FIG. 13B is a view showing the state of use of the work chair according to the eleventh embodiment of the present invention.

FIG. 13A is an exploded development view showing a work chair according to an eleventh embodiment of the present invention, and FIG. 13B is a view showing the state of use of the work chair according to the tenth embodiment of the present invention.

As shown in FIGS. 13A and 13B, according to the eleventh embodiment of the present invention, the pelvis belt 20 may include a main pelvis belt 21, which is fixed to each of opposite sides of the upper portion of the cushion chair 10 and is removably worn around the pelvis in a horizontal direction, and an auxiliary pelvis belt 22, which is fixed to opposite sides of the lower middle portion of the cushion chair 10, extends in an oblique direction, and is fixed to the main pelvis belt 21 so as to be worn around the pelvis. The safety belt 30 may include an upper-oblique safety belt 34, which extends from a lower-center safety belt 33 fixed to the lower portion of the cushion chair 10 and is detachably fastened to opposite sides of the front portion of the auxiliary pelvis belt 22 over both thighs.

The embodiment is preferable in that the crap between the main pelvis belt 21 and the auxiliary pelvis belt 22 is increased, and the cushion chair 10, centered on a part of the buttocks around the anus, is much more firmly held by the three-dimensional triangular structure formed by the main pelvis belt 21, the auxiliary pelvis belt 22 and the safety belt 30, because the main pelvis belt 21 and the auxiliary pelvis belt 22 are wrapped around the pelvis, thereby more stably centering the cushion chair 10 on a part of the buttocks around the anus, and the safety belt 30 includes the upper-oblique safety belt 34, which extends from the lower-center safety belt 33 fixed to the lower portion of the cushion chair 10 and is detachably fastened to opposite sides of the front portion of the auxiliary pelvis belt 22 over both thighs.

Figure 14:
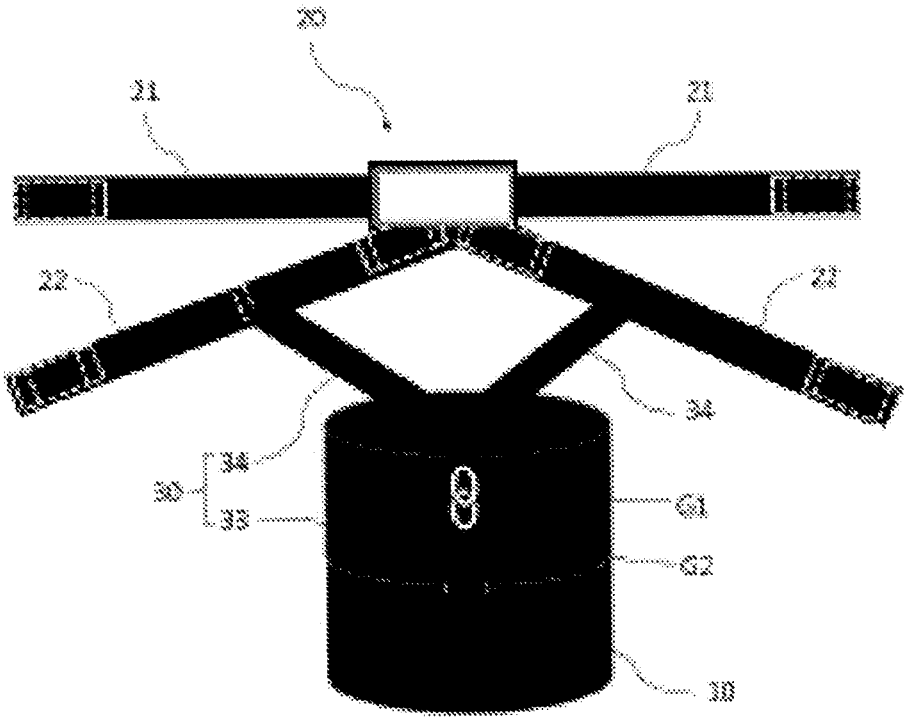
FIG. 14 is an exploded development view showing a work chair according to a twelfth embodiment of the present invention.

FIG. 14 is an exploded development view showing a work chair according to a twelfth embodiment of the present invention.

As shown in FIG. 14, according to the twelfth embodiment of the present invention, the pelvis belt 20 may include a main pelvis belt 21, which is fixed to each of opposite skies of the upper portion of the cushion chair 10 and is removably worn around the pelvis in a horizontal direction, and an auxiliary pelvis belt 22, which is fixed to opposite sides of the lower middle portion of the cushion chair 10, extends in an oblique direction, and is fixed to the main pelvis belt 21 so as to be worn around the pelvis. The safety belt 30 may include a lower-center safety belt 33 fixed to the lower portion of the cushion chair 10 and an upper-oblique safety belt 34 fixed to opposite sides of the front portion of the auxiliary pelvis belt 22. The lower-center safety belt 33 and the upper-oblique safety belt 34 may be detachably fastened to each other over both thighs.

The embodiment is preferable in that the gap between the main pelvis belt 21 and the auxiliary pelvis belt 22 is increased, and the cushion chair 10, centered on a part of the buttocks around the anus, is much more firmly held by the three-dimensional triangular Structure formed by the main pelvis belt 21, the auxiliary pelvis belt 22 and the safety belt 30, because the main pelvis belt 21 and the auxiliary pelvis belt 22 are wrapped around the pelvis, thereby more stably centering the cushion chair 10 on a part of the buttocks around the anus, and the lower-center safety belt 33 fixed to the cushion chair 10 and the upper-oblique safety belt 34 fixed to the auxiliary pelvis belt 22 are detachably fastened to each other.

Figure 15A:
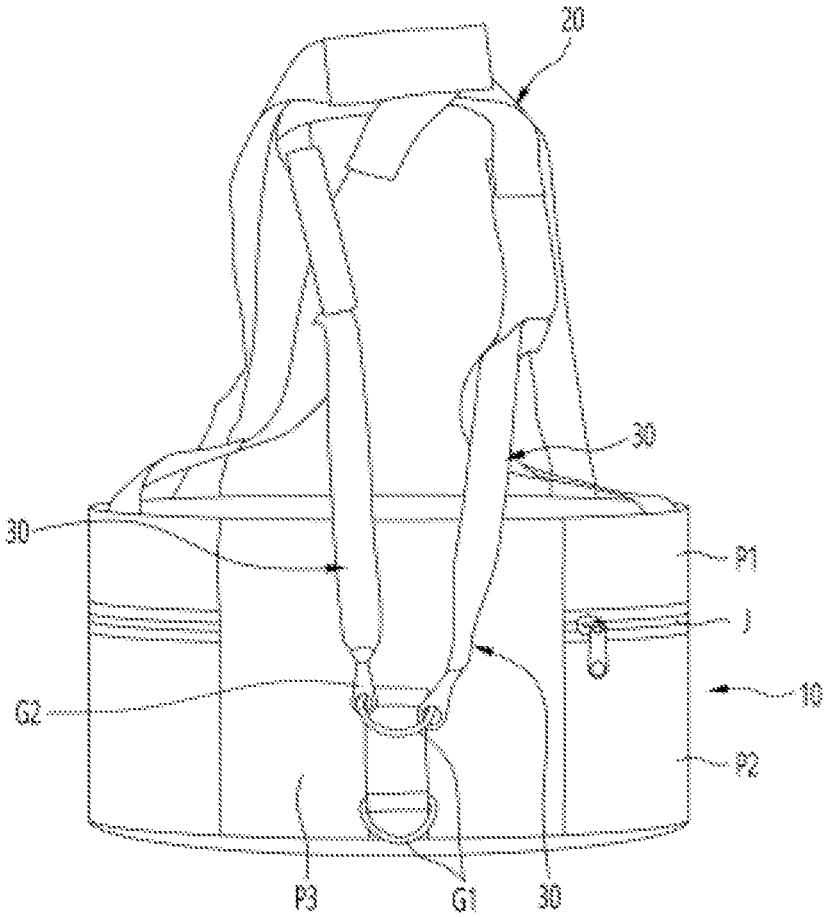
FIGS. 15A and 15B are pictures of a sample of a work chair according to an embodiment of the present invention.
Figure 15B:
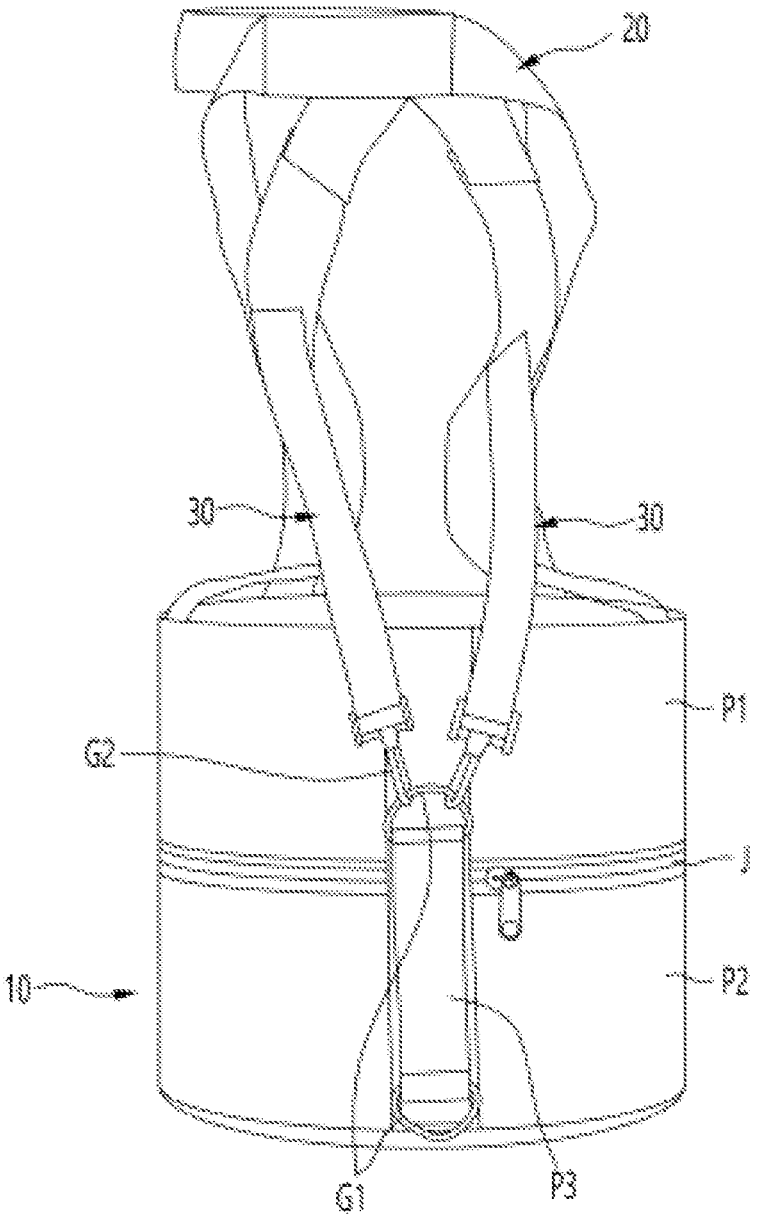

FIGS. 15A and 15B are pictures of a sample of a work chair according to an embodiment of the present invention.

As shown in FIGS. 15A and 15B, according to the present invention, the cushion chair includes a top-surface cover member Pi and a bottom-surface cover member P2, which are vertically connected to each other via a vertical cover member P3 and accommodate a cushion material, which is not illustrated, therein, and further includes a zipper J provided on the side surface thereof so as to be opened or closed in a lateral direction. The safety belt 30 is connected to the vertical cover member P3.

In the state in which the top-surface cover member P1 and the bottom-surface cover member P2 are opened with respect to the vertical cover member P3 by opening the zipper J, Styrofoam or any other foam is fitted thereinto, and subsequently, the zipper J is closed, thereby completing the form of the cushion chair 10. In this case, when the safety belt 30 is worn, tensile force is applied to the safety belt 30 in a vertical direction. Thus, in the case in which the safety belt 30 is directly attached to the top-surface cover member P1 or to the bottom-surface cover member P2, the safety belt 30 may be easily torn out, and thus the lifespan of the work chair may be shortened. According to the present invention, in order to prevent the safety belt 30 from being easily separated from the cushion chair 10, the safety belt 30 is connected to the vertical cover member P3 in a manner capable of withstanding tensile force in a vertical direction (fixation through sewing of a thread or the like and detachable fastening using a fixing ring G1 and a fastening hook G2), thereby enabling long-term use.

The safety belt 30 may be fixed by sewing a thread or the like, and may be detachably fastened using the fastening hook G2 configured to be hooked to the fixing ring G1, and the pelvis belt 20 may be provided in a singular or plural number. However, the present invention is not necessarily limited thereto.

Figure 16A:
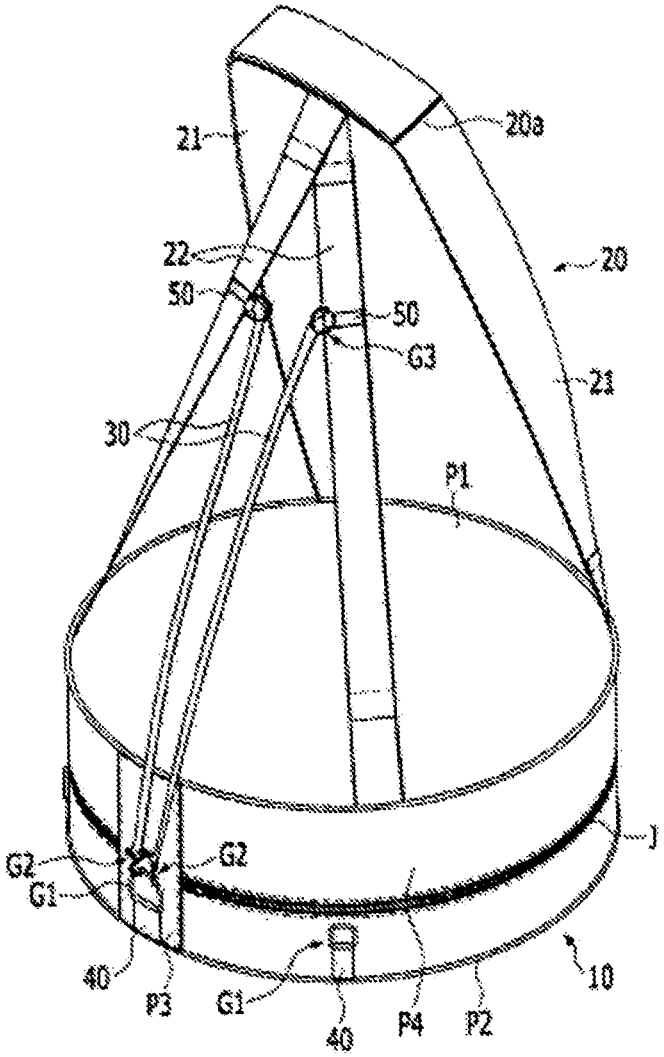
FIG. 16A is a perspective view showing a work chair according to a thirteenth embodiment of the present invention.
Figure 16B:
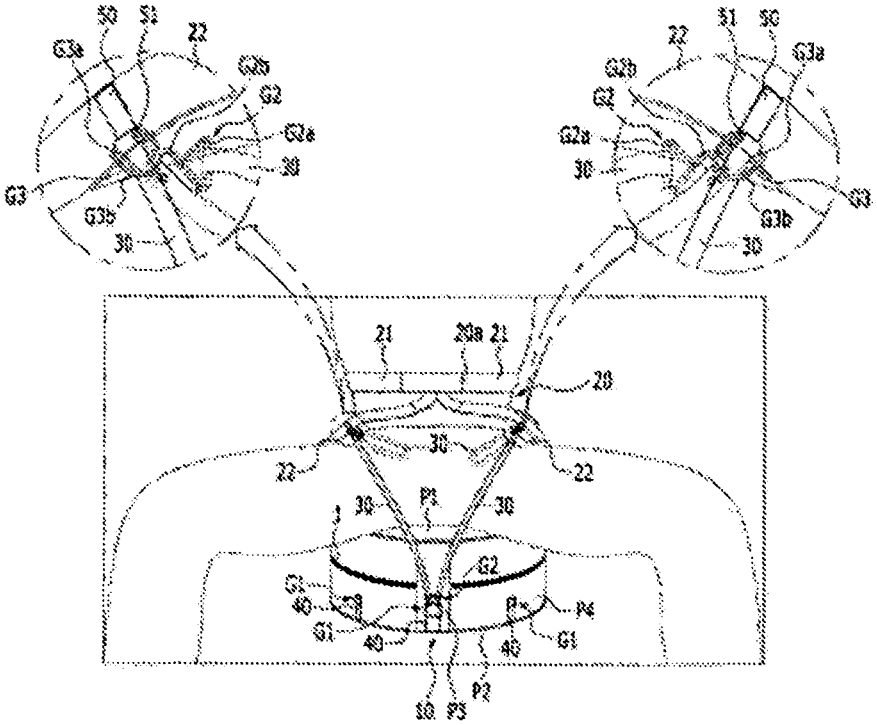
FIG. 16B is a view showing the state of use of the work chair according to the thirteenth embodiment of the present invention.
Figure 17A:
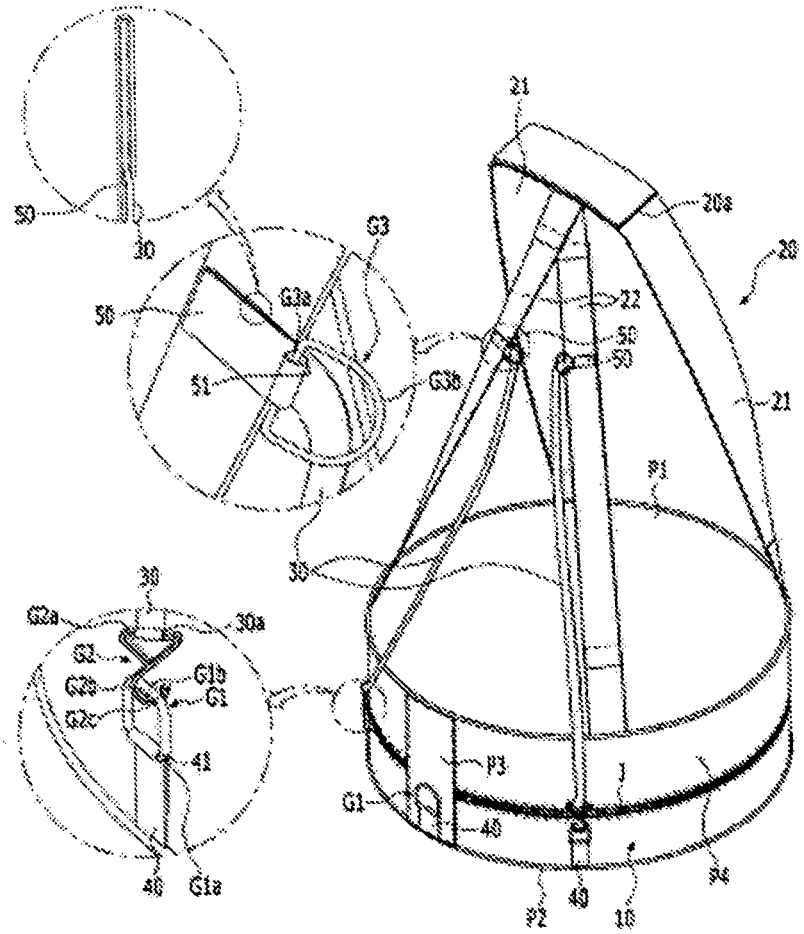
FIG. 17A is a perspective view showing a work chair according to a fourteenth embodiment of the present invention.
Figure 17B:
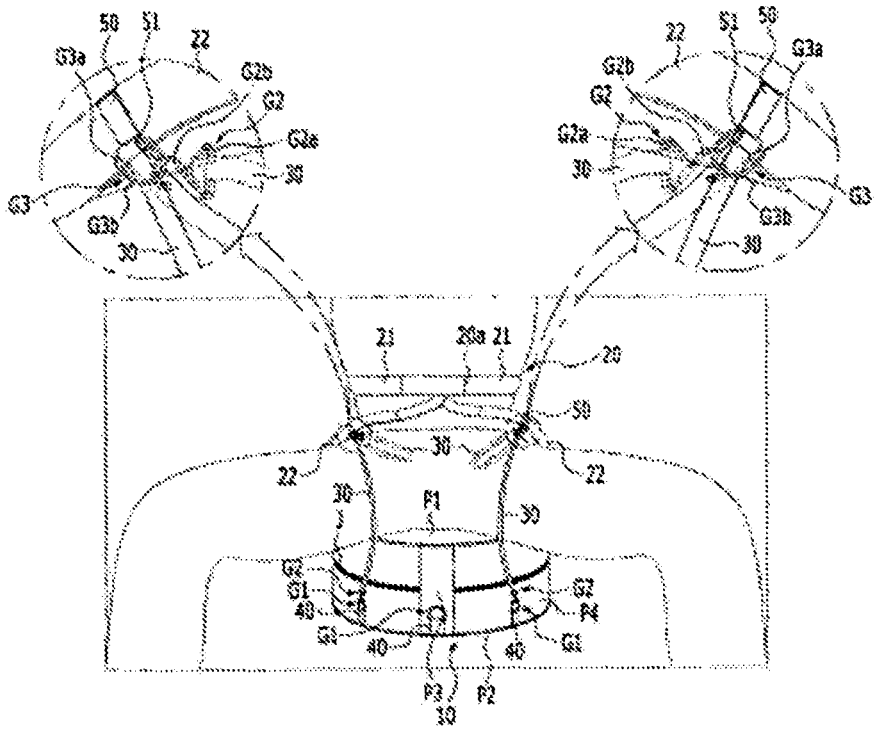
FIG. 17B is a view showing the state of use of the work chair according to the fourteenth embodiment of the present invention.

FIG. 16A is a perspective view showing a work chair according to a thirteenth embodiment of the present invention, FIG. 16B is a view showing the state of use of the work chair according to the thirteenth embodiment of the present invention, FIG. 17A is a perspective view showing a work chair according to a fourteenth embodiment of the present invention, and FIG. 17B is a view showing the state of use of the work chair according to the fourteenth embodiment of the present invention.

As shown in FIGS. 16A to 17B, the work chair according to the thirteenth embodiment and the fourteenth embodiment of the present invention includes a cushion chair 10, which is brought into close contact with the buttocks to cushion the same, a pelvis belt 20, which is fixed to each of opposite sides of the cushion chair 10 and is removably worn around the pelvis, and a safety belt 30, which is detachably fastened both to the cushion chair 10 and to the pelvis belt 20 so as to center the cushion chair 10 on a part of the buttocks around the anus.

In this case, the present invention is mainly characterized in that the cushion chair 10 is provided with a fixing ring G1, the safety belt 30 is fixed to the pelvis belt 20 so as to hang down and is provided with a fastening hook G2 configured to be hooked to the fixing ring G1 when the safety belt 30 is worn, and the pelvis belt 20 is provided with a collection ring G3, to which the fastening hook G2 is returned upwards and hooked when the safety belt 30 is not worn.

The worker, who performs tasks using the work chair, stays in one place, frequently sits and stands, or moves while squatting. It is necessary to maximally protect the worker from accidents in a workplace.

When the worker performs tasks in a workplace, the safety belt 30 is detachably fastened both to the cushion chair 10 and to the pelvis belt 20 so as to center the cushion chair 10 on a part of the buttocks around the anus for convenience and safety in use. However, when taking a rest or going to the restroom, the worker temporarily releases the safety belt 30 so that the safety belt 30 is removed from the worker and hangs down.

In this case, the safety belt 30, which is removed from the worker and hangs down, may catch on any of various machines that are operating in the workplace, which may lead to a very serious accident.

Therefore, according to the present invention, when the safety belt 30 is worn, the safety belt 30 centers the cushion chair 10 on a part of the buttocks around the anus, and when the safety belt 30 is not worn, the fastening hook G2 is returned upwards and hooked to the collection ring G3 so that the safety belt 30 is reduced in length, thereby protecting the worker from accidents, and preventing the safety belts 30 from banging down in disorder when the work chairs are stored, thus enabling storage of the work chairs in a neat and tidy manner.

Specifically, the cushion chair 10 is composed of a top-surface cover member P1, a bottom-surface cover member P2, and a side-surface cover member P4, in which a cushion material is accommodated. The fixing ring G1 includes a horizontal fixing bar G1*a*, which is inserted into a horizontal fixing hole 41, formed in the upper end of a fixing band 40, so as to be rotatable in a vertical direction, the fixing, band 40 being sewn to the boundary between the bottom-surface cover member P2 and the side-surface cover member P4 and being further sewn to the side-surface cover member P4 while extending upwards along the side-surface cover member P4 and then extending downwards, and a rounded fixing bar G1*b*, which extends from opposite ends of the horizontal fixing bar G1*a* so as to be rounded in a closed-loop shape so that the fastening book G2 is detachably hooked thereto.

Since the fixing band 40 is sewn to the boundary between the bottom-surface cover member P2 and the side-surface cover member P4, it is possible to ensure firm fixation thereof when the safety belt 30 is worn, thus increasing the lifespan thereof. In addition, since the fixing band 40 is further sewn to the side-surface cover member P4 while extending upwards and then extending downwards, it is possible to further enhance firmness of fixation thereof Since the horizontal fixing bar G1*a* is inserted into the horizontal fixing hole 41 formed in the upper end of the fixing hand 40 so as to be rotatable in a vertical direction, it is possible to enable the fastening hook G2 to be smoothly hooked to and released from the rounded fixing bar G1*b*, thus ensuring convenience in use.

According to the fourteenth embodiment of the present invention, the fixing ring G1 is provided at each of a front surface of the cushion chair 10, a left surface that is spaced apart from the front surface to the left, and a right surface that is spaced apart from the front surface to the right, thereby enabling the fastening hook G2 to be selectively hooked to the fixing ring G1 that is provided at each of the front surface, the left surface and the right surface of the cushion chair 10 according to the shapes of the pelvis and the thighs of the human body.

Workers may have respectively different body shapes, e.g. different sizes of pelvises or different thicknesses of thighs, and accordingly, the safety belt 30 may be manufactured to have a structure that is capable of being increased or reduced in size (a length-adjustable structure). Preferably, the safety belt 30 is made of art elastic material taking into consideration working efficiency and convenience in use.

In this case, the force by which the safety belt 30 is fastened may be reduced by hooking the fastening hook G2 to the fixing ring G1 provided at the front surface of the cushion chair 10, and the force by which the safety belt 30 is fastened may be increased (to be tighter around the thighs) by hooking the fastening hook G2 to the fixing ring G1 provided at each of the left surface and the right surface of the cushion chair 10. In this manner, the safety belt 30 may be selectively fastened so that the worker feels comfortable, thereby maximizing convenience in use.

Meanwhile, the collection ring G3 includes a horizontal collection bar G3*a*, which is inserted into a horizontal collection hole 51, formed in the lower end of a collection band 50, so as to be rotatable in a vertical direction, the collection band 50 extending upwards and then extending downwards while contacting the pelvis belt 20, with the safety belt 30 sandwiched therebetween, and being sewn to the pelvis belt 20 while again extending upwards over the safety belt 30, and a rounded collection bar G3*b*, which extends from opposite ends of the horizontal collection bar G3*a* so as to be rounded in a closed-loop shape so that the fastening hook G2 is detachably hooked thereto.

In the case in which the safety belt 30 is simply sewn to the pelvis belt 20 while being brought into planar contact with the pelvis belt 20, the safety belt 30 may be easily torn out after a short period of use, i.e. may have a short lifespan. According to the present invention, the collection ring G3 is fixed to the pelvis belt 20 together with the safety belt 30. In particular, the collection band 50 extends upwards and then extends downwards while contacting the pelvis belt 20, with the safety belt 30 sandwiched therebetween, and is sewn to the pelvis belt 20 while again extending upwards over the safety belt 30, thereby ensuring firm fixation of the safety belt 30. Further, since the horizontal collection bar G3*a* of the collection ring G3 is inserted into the horizontal collection hole 51 formed in the lower end of the collection band 50 so as to be rotatable in a vertical direction, it is possible to enable the fastening hook G2 to be smoothly hooked thereto and released therefrom, thus maximizing convenience in use.

In addition, the fastening hook G2 includes a horizontal fastening bar G2*a,* which is inserted into a horizontal fastening hole 30*a*, formed in the lower end of the safety belt 30, so as to be rotatable in a vertical direction, and a rounded fastening bar G2*b,* which extends from opposite ends of the horizontal fastening bar G2*a* so as to be bent in a closed-loop shape and then to be rounded in an open shape, to thereby be selectively and detachably hooked to the fixing ring G1 or to the collection ring G3.

Since the horizontal fastening bar G2*a* of the fastening hook G2 rotates in a vertical direction in the state of being inserted into the horizontal fastening hole 30*a* and firmly supports the rounded fastening bar G2*b,* which extends from opposite ends thereof and is bent in a closed-loop shape, it is possible to prevent separation of the fastening hook G2 during use and to facilitate selective fastening of the fastening hook G2 to the fixing ring G1 or to the collection ring G3 using the rounded fastening bar G2*b,* which is rounded in an open shape, thereby ensuring convenience in use.

In this case, the fastening hook G2 further includes a stopper G2*c*, which protrudes inwards from the inner surface of the distal end of the rounded fastening bar G2*b* that is rounded in an open shape, thereby preventing unintended release of the fastening hook G2 from the fixing ring G1 or from the collection ring G3, thus maintaining a more firmly fastened state.

Further, the horizontal fastening hole 30*a* is formed in the lower end of the safety belt 30 in a manner such that the distal end portion of the safety belt 30 is folded inwards and is sewn, thereby preventing the weft and the warp of the safety belt 30, which is manufactured by weaving a synthetic fiber, from becoming unwoven during use thereof.

According to the present invention, as shown in FIGS. 6A and 6B, the safety belt 30 is fixed to the center of the front portion of the pelvis belt 20 so that the fastening hook G2 is detachably fastened to the fixing ring G1 of the cushion chair 10. According to the present invention, as shown in FIGS. 7A, 7B, 8A, and 16A to 17B, the safety belt 30 is fixed to opposite sides of the front portion of the pelvis belt 20 so that the fastening hook G2 is detachably fastened to the fixing ring G1 of the cushion chair 10.

In particular, as shown in FIGS. 16A to 17B, the pelvis belt 20 includes a main pelvis belt 21, which is fixed to each of opposite sides of the upper portion of the cushion chair 10 and is removably worn around the pelvis in a horizontal direction, and an auxiliary pelvis belt 22, which is fixed to opposite sides of the lower middle portion of the cushion chair 10, extends in an oblique direction, and is fixed to the main pelvis belt 21 so as to be worn around the pelvis. The safety belt 30 is fixed to opposite sides of the front portion of the auxiliary pelvis belt 22 so that the fastening hook G2 is detachably fastened to the fixing ring GI of the cushion chair 10.

The present invention is capable of being used in various industrial sites in which workers work while kneeling or squatting.

The invention claimed is:

1. A work chair comprising a cushion chair configured to be brought into close contact with buttocks to cushion the buttocks and a pelvis belt fixed to each of opposite sides of the cushion chair and configured to be removably worn around a pelvis, the work chair comprising:

a safety belt detachably secured to a lower portion of the cushion chair and to a front portion of the pelvis belt so as to center the cushion chair on a part of the buttocks around an anus, wherein the safety belt is fixed to the lower portion of the cushion chair and is detachably fastened to the front portion of the pelvis belt, wherein the pelvis belt comprises a main pelvis belt, fixed to each of opposite sides of an upper portion of the cushion chair and removably worn around the pelvis in a horizontal direction, and an auxiliary pelvis belt, fixed to opposite sides of a lower middle portion of the cushion chair, extending in an oblique direction, and fixed to the main pelvis belt so as to be worn around the pelvis, and wherein the safety belt is fixed to the lower portion of the cushion chair and is detachably fastened to opposite sides of a front portion of the auxiliary pelvis belt over both thighs so that a gap between the main pelvis belt and the auxiliary pelvis belt is increased, and the cushion chair, centered on a part of the buttocks around the anus, is firmly held by a three-dimensional triangular structure formed by the main pelvis belt, the auxiliary pelvis belt and the safety belt.

2. The work chair according to claim 1, wherein the cushion chair comprises a top-surface cover member and a bottom-surface cover member, vertically connected to each other via a vertical cover member and accommodating a cushion material therein, and further comprises a zipper provided on a side surface thereof so as to be opened or closed in a lateral direction, and wherein the safety belt is connected to the vertical cover member.

3. A work chair comprising a cushion chair configured to be brought into close contact with buttocks to cushion the buttocks and a pelvis belt fixed to each of opposite sides of the cushion chair and configured to be removably worn around a pelvis, the work chair comprising:

a safety belt detachably secured to a lower portion of the cushion chair and to a front portion of the pelvis belt so as to center the cushion chair on a part of the buttocks around an anus, wherein the safety belt is fixed to the front portion of the pelvis belt and is detachably fastened to the lower portion of the cushion chair, wherein the pelvis belt comprises a main pelvis belt, fixed to each of opposite sides of an upper portion of the cushion chair and removably, worn around the pelvis in a horizontal direction, and an auxiliary pelvis belt, fixed to opposite sides of a lower middle portion of the cushion chair, extending in an oblique direction, and fixed to the main pelvis belt so as to be worn around the pelvis, and wherein the safety belt is fixed to opposite sides of a front portion of the auxiliary pelvis belt and is detachably fastened to the lower portion of the cushion chair so that a gap between the main pelvis belt and the auxiliary pelvis belt is increased, and the cushion chair, centered on a part of the buttocks around the anus, is firmly held by a three-dimensional triangular structure formed by the main pelvis belt, the auxiliary pelvis belt and the safety belt.

4. A work chair comprising a cushion chair configured to be brought into close contact with buttocks to cushion the buttocks and a pelvis belt fixed to each of opposite sides of the cushion chair and configured to be removably worn around a pelvis, the work chair comprising:

a safety belt detachably secured to a lower portion of the cushion chair and to a front portion of the pelvis belt so as to center the cushion chair on a part of the buttocks around an anus, wherein the safety belt is detachably fastened to the lower portion of the cushion chair and to the front portion of the pelvis belt, wherein the pelvis belt comprises a main pelvis belt, fixed to each of opposite sides of an upper portion of the cushion chair and removably worn around the pelvis in a horizontal direction, and an auxiliary pelvis belt, fixed to opposite sides of a lower middle portion of the cushion chair, extending in an oblique direction, and fixed to the main pelvis belt so as to be worn around the pelvis, and wherein the safety belt is detachably fastened to the lower portion of the cushion chair and to opposite sides of a front portion of the auxiliary pelvis belt over both thighs so that a gap between the main pelvis belt and the auxiliary pelvis belt is increased, and the cushion chair, centered on a part of the buttocks around the anus, is firmly held by a three-dimensional triangular structure formed by the main pelvis belt, the auxiliary pelvis belt and the safety belt.

5. A work chair comprising a cushion chair configured to be brought into close contact with buttocks to cushion the buttocks and a pelvis belt fixed to each of opposite sides of the cushion chair and configured to be removably worn around a pelvis, the work chair comprising:

a safety belt detachably secured to a lower portion of the cushion chair and to a front portion of the pelvis belt so as to center the cushion chair on a part of the buttocks around an anus, wherein the pelvis belt comprises a main pelvis belt, fixed to each of opposite sides of an upper portion of the cushion chair and removably worn around the pelvis in a horizontal direction, and an auxiliary pelvis belt, fixed to opposite sides of a lower middle portion of the cushion chair, extending in an oblique direction, and fixed to the main pelvis belt so as to be worn around the pelvis, and wherein the safety belt comprises an upper-oblique safety belt extending from a lower-center safety belt, fixed to the lower portion of the cushion chair, and detachably fastened to opposite sides of a front portion of the auxiliary pelvis belt over both thighs so that a gap between the main pelvis belt and the auxiliary pelvis belt is increased, and the cushion chair, centered on a part of the buttocks around the anus, is firmly held by a three-dimensional triangular structure formed by the main pelvis belt, the auxiliary pelvis belt and the safety belt.

6. A work chair comprising a cushion chair configured to be brought into close contact with buttocks to cushion the buttocks and a pelvis belt fixed to each of opposite sides of the cushion chair and configured to be removably worn around a pelvis, the work chair comprising:

a safety belt detachably secured to a lower portion of the cushion chair and to a front portion of the pelvis belt so as to center the cushion chair on a part of the buttocks around an anus, wherein the pelvis belt comprises a main pelvis belt, fixed to each of opposite sides of an upper portion of the cushion chair and removably worn around the pelvis in a horizontal direction, and an auxiliary pelvis belt, fixed to opposite sides of a lower middle portion of the cushion chair, extending in an oblique direction, and fixed to the main pelvis belt so as to be worn around the pelvis, and wherein the safety belt comprises a lower-center safety belt fixed to the lower portion of the cushion chair and an upper-oblique safety belt fixed to opposite sides of a front portion of the auxiliary pelvis belt, and the lower-center safety belt and the upper-oblique safety belt are detachably fastened to each other over both thighs so that a gap between the main pelvis belt and the auxiliary pelvis belt is increased, and the cushion chair, centered on a part of the buttocks around the anus, is firmly held by a three-dimensional triangular structure formed by the main pelvis belt, the auxiliary pelvis belt and the safety belt.

* * * * *